US011850701B2

(12) United States Patent
Tu et al.

(10) Patent No.: US 11,850,701 B2
(45) Date of Patent: Dec. 26, 2023

(54) POLISHING PAD, MANUFACTURING METHOD OF POLISHING PAD AND POLISHING METHOD

(71) Applicant: IV Technologies CO., Ltd., Taichung (TW)

(72) Inventors: Liang-Chi Tu, Taichung (TW); Yu-Piao Wang, Hsinchu County (TW)

(73) Assignee: IV Technologies CO., Ltd., Taichung (TW)

( * ) Notice: Subject to any disclaimer, the term of this patent is extended or adjusted under 35 U.S.C. 154(b) by 728 days.

(21) Appl. No.: 16/827,647

(22) Filed: Mar. 23, 2020

(65) Prior Publication Data

US 2020/0306923 A1 Oct. 1, 2020

(30) Foreign Application Priority Data

Mar. 25, 2019 (TW) ..... 108110320

(51) Int. Cl.
*B24B 37/26* (2012.01)
*B24B 37/22* (2012.01)

(52) U.S. Cl.
CPC ..... *B24B 37/26* (2013.01); *B24B 37/22* (2013.01)

(58) Field of Classification Search
CPC ..... B24B 37/26; B24B 37/22
See application file for complete search history.

(56) References Cited

U.S. PATENT DOCUMENTS

2011/0014853 A1* 1/2011 Wang ..... B24B 37/26 451/28
2012/0073210 A1* 3/2012 Lefevre ..... B24D 18/00 51/298
2018/0361532 A1* 12/2018 Nguyen ..... B24B 37/042

FOREIGN PATENT DOCUMENTS

| | | |
|---|---|---|
| CN | 105390417 | 3/2016 |
| CN | 205703794 | 11/2016 |
| TW | I458591 | 11/2014 |
| TW | 201617172 | 5/2016 |
| TW | 201618898 | 6/2016 |
| TW | 201729948 A * | 9/2017 |
| TW | I642516 | 12/2018 |

OTHER PUBLICATIONS

"Office Action of Taiwan Counterpart Application", dated May 14, 2020, p. 1-p. 12.

* cited by examiner

*Primary Examiner* — Binh X Tran
(74) *Attorney, Agent, or Firm* — JCIPRNET

(57) ABSTRACT

A polishing pad is provided. The polishing surface of the polishing pad corresponds to a two-dimensional orthogonal coordinate system having a first coordinate direction and a second coordinate direction, the rotating axis of the polishing pad corresponds to the original point of the two-dimensional orthogonal coordinate system, and the polishing pad includes a polishing layer and a surface pattern. The surface pattern is disposed in the polishing layer, and includes at least one first groove and at least one second groove respectively distributing along the first coordinate direction, wherein the at least one first groove has a first cutting trajectory direction, the first cutting trajectory direction is forward with the first coordinate direction, and the at least one second groove has a second cutting trajectory direction, (Continued)

the second cutting trajectory direction is reverse with the first coordinate direction.

30 Claims, 10 Drawing Sheets

POLISHING PAD, MANUFACTURING METHOD OF POLISHING PAD AND POLISHING METHOD

CROSS-REFERENCE TO RELATED APPLICATION

This application claims the priority benefit of Taiwan application serial no. 108110320, filed on Mar. 25, 2019. The entirety of the above-mentioned patent application is hereby incorporated by reference herein and made a part of this specification.

BACKGROUND

Technical Field

The present invention relates to a polishing pad, a manufacturing method of a polishing pad, and a polishing method, and more particularly to a polishing pad, a manufacturing method of a polishing pad, and a polishing method that contribute to render a polishing fluid having different flow field distribution.

Description of Related Art

In the manufacturing process of industrial components, the polishing procedure is a technique commonly used today to planarize the surface of an object being polished. Generally speaking, the polishing procedure is carried out by the chemical reaction of the polishing fluid supplied between the surface of the object and the polishing pad, and by the mechanical friction generated by the relative motion between the object and the polishing pad to achieve the planarization. The polishing pad retains and transports the polishing fluid through multiple grooves on the surface of the polishing layer. With the development of the industry, the flow field distributions of the polishing fluid required by various polishing procedure applications are different. Therefore, there is still a need to provide a polishing pad with different flow field distribution of polishing fluid for industrial choice.

SUMMARY

The present invention provides a polishing pad, a manufacturing method of the polishing pad, and a polishing method, which make the polishing fluid have different flow field distribution for industrial selection.

The polishing surface of the polishing pad of the present invention corresponds to a two-dimensional orthogonal coordinate system having a first coordinate direction and a second coordinate direction, the rotating axis corresponds to the original point of the two-dimensional orthogonal coordinate system, and includes a polishing layer and a surface pattern. The surface pattern is arranged in the polishing layer and includes at least one first groove and at least one second groove respectively distributing along the first coordinate direction, wherein at least one first groove has a first cutting trajectory direction, the first cutting trajectory direction is forward with the first coordinate direction, at least one second groove has a second cutting trajectory direction, and the second cutting trajectory direction is reverse with the first coordinate direction.

The polishing pad of the present invention includes a polishing layer and a surface pattern. The surface pattern is arranged in the polishing layer and includes at least one first groove and at least one second groove with the same shape distribution, wherein the at least one first groove has a first cutting trajectory direction, the at least one second groove has a second cutting trajectory direction, and the first cutting trajectory direction is opposite to the second cutting trajectory direction.

The polishing pad of the present invention is used for polishing an object, wherein the polishing pad has a motion direction during polishing procedure, and the polishing pad includes a polishing layer, at least one first groove, and at least one second groove. The at least one first groove is disposed in the polishing layer, wherein the at least one first groove has a first cutting trajectory direction, and the first cutting trajectory direction is forward with the motion direction. The at least one second groove is disposed in the polishing layer, wherein the at least one second groove has a second cutting trajectory direction, and the second cutting trajectory direction is reverse with the motion direction.

The manufacturing method of the polishing pad of the present invention includes the following steps. A polishing layer surface is provided. A cutting device is used to form at least one first groove on the polishing surface along a first cutting trajectory direction, and form at least one second groove on the polishing surface along a second cutting trajectory direction, wherein the at least one first groove is adjacent to the at least one second groove, and the first cutting trajectory direction is opposite to the second cutting trajectory direction.

The polishing method of the present invention includes the following steps. A polishing pad is provided, wherein the polishing pad is the polishing pad described above. A pressure is applied to an object to press the object on the polishing pad. A relative motion is applied to the object and the polishing pad to perform a polishing procedure.

Based on the above, in the polishing pad of the present invention, the at least one first groove has the first cutting trajectory direction, the at least one second groove has the second cutting trajectory direction, and the first cutting trajectory direction is opposite to the second cutting trajectory direction, thereby when using the polishing pad to perform the polishing procedure on the object, the polishing pad makes the polishing fluid have different flow field distribution to meet the requirement of different polishing process application.

In order to make the aforementioned features and advantages of the disclosure more comprehensible, embodiments accompanied with figures are described in detail below.

DESCRIPTION OF THE EMBODIMENTS

As used herein, "about," "approximately," "essentially" or "substantially" is inclusive of the stated value and means within an acceptable range of deviation for the particular value as determined by persons of ordinary skill in the art, considering the measurement in question and the error associated with measurement of the particular quantity (i.e., the limitations of the measurement system). For example, "about" may mean within one or more standard deviations, or within, for example, ±30%, ±20%, ±15%, ±10%, ±5% of the stated value. Moreover, a relatively acceptable range of deviation or standard deviation may be chosen for the term "about," "approximately," "essentially" or "substantially" as used herein based on measurement properties, cutting properties or other properties, instead of applying one standard deviation across all the properties.

In the accompanying drawings, thicknesses of layers, films, panels, regions and so on are exaggerated for clarity. It should be understood that when a groove is referred to as being "adjacent" to another groove, there is no groove between the groove and the other groove.

Figure 1:
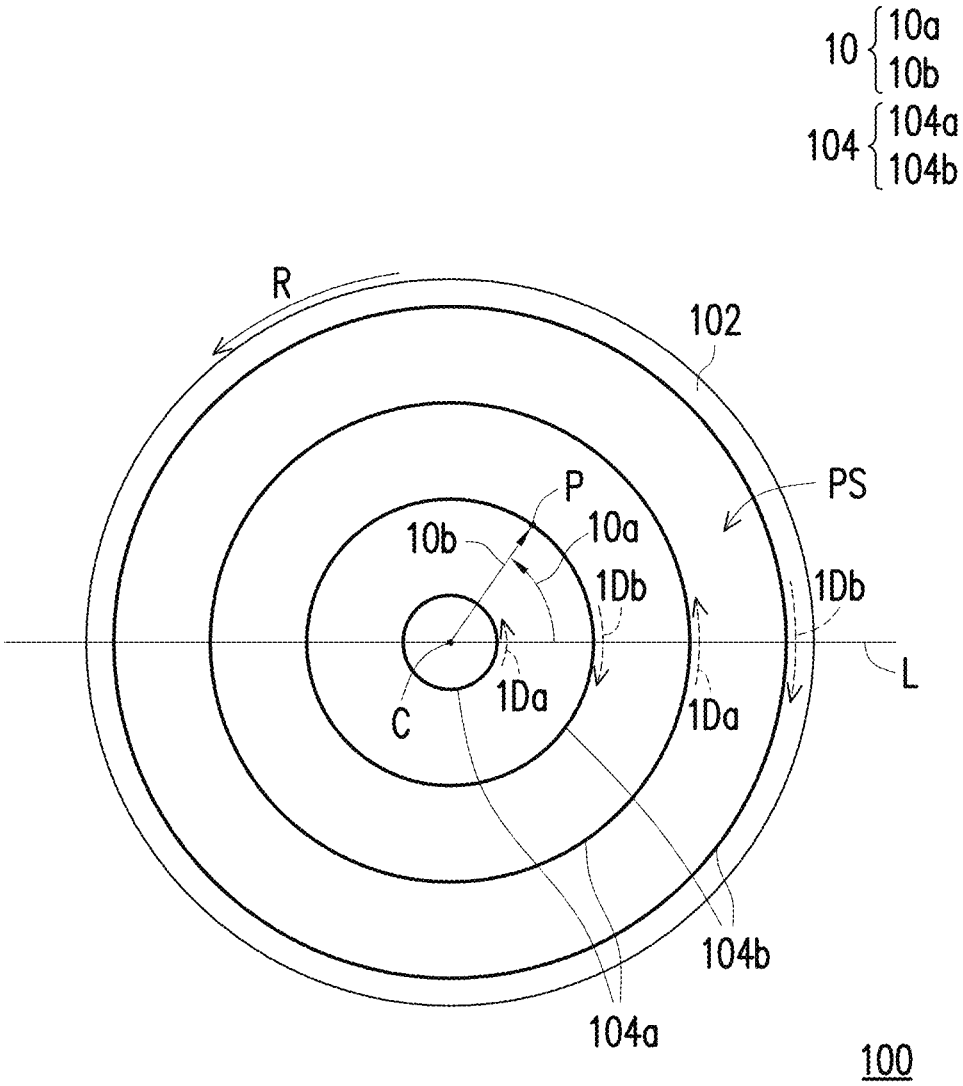
FIG. 1 is a schematic top view of a polishing pad according to an embodiment of the present invention.

FIG. 1 is a schematic top view of a polishing pad according to an embodiment of the present invention.

Referring to FIG. 1, a polishing pad 100 includes a polishing layer 102 and a surface pattern 104 disposed in the polishing layer 102. In the present embodiment, the polishing layer 102 has a polishing surface PS. When the polishing procedure is performed on the object using the polishing pad 100, the object contacts the polishing surface PS of the polishing layer 102. In the present embodiment, the polishing surface PS corresponds to a two-dimensional orthogonal coordinate system 10 having a first coordinate direction 10*a* and a second coordinate direction 10*b*. As shown in FIG. 1, the two-dimensional orthogonal coordinate system 10 is a polar coordinate system, the first coordinate direction 10*a* is an angular coordinate direction, and the second coordinate direction 10*b* is a radial coordinate direction. Those skilled in the art should understand, the radial coordinate represents the distance from the original point of the two-dimensional orthogonal coordinate system 10 to the pole P, and the angular coordinate represents the angular arc of the connection line between the pole P and the original point of the two-dimensional orthogonal coordinate system 10 with respect to the polar axis L in a counterclockwise direction, and the polar axis L is the X-axis in the rectangular coordinate system. In view of this, those skilled in the art should understand that the first coordinate direction 10*a* is also the circumferential direction, and the second coordinate direction 10*b* is also the radial direction. In addition, because the angular coordinate represents the angular arc of the connection line between the pole P with the original point of the two-dimensional orthogonal coordinate system 10 in a counterclockwise direction with respect to the polar axis L, the first coordinate direction 10*a* (i.e., the angular coordinate direction) is a counterclockwise direction.

In the present embodiment, the polishing pad 100 has a rotating axis C, and the rotating axis C corresponds to the original point of the two-dimensional orthogonal coordinate system 10. In addition, as shown in FIG. 1, the rotating axis C is located at the center of the polishing pad 100. Taking the polishing pad 100 shown in FIG. 1 as a circle, the center of the polishing pad 100 is the center of the circle, that is, the rotating axis C is located at the center of the circle of the polishing pad 100. When using the polishing pad 100 to perform the polishing procedure on the object, the polishing pad 100 is fixed on a polishing platen (not shown) of the polishing equipment, and the polishing pad 100 is driven by the polishing platen to rotate along the rotating axis C in the motion direction R. As shown in FIG. 1, with respect to the rotating axis C of the polishing pad 100 (i.e., the center of the polishing pad 100), the motion direction R is a counterclockwise direction, that is, the polishing pad 100 rotates in a counterclockwise direction. However, the invention is not limited thereto. In other embodiments, the motion direction R may also be a clockwise direction.

In the present embodiment, the polishing layer 102 may be composed of a polymer base material. For example, the polymer base material may be polyester, polyether, polyurethane, polycarbonate, polyacrylate, polybutadiene, other polymer base materials synthesized by suitable thermosetting resins or thermoplastic resins, or a combination thereof. In addition, although not shown in FIG. 1, those skilled in the art should understand that the polishing pad 100 may be provided with a base layer, a waterproof layer, an adhesive layer or a combination thereof under the polishing layer 102.

In the present embodiment, the surface pattern 104 may include at least one first groove 104*a* and at least one second groove 104*b*. As shown in FIG. 1, the at least one first groove 104*a* is exemplified by two first grooves 104*a*, and the at least one second groove 104*b* is exemplified by two second grooves 104*b*. However, the present invention is not limited thereto. The number of the first grooves 104*a* and the number of the second grooves 104*b* can be designed to be one or three or more according to actual needs.

In the present embodiment, the first grooves 104*a* and the second grooves 104*b* are respectively distributed along the first coordinate direction 10*a*. That is, in the present embodiment, the first grooves 104*a* and the second grooves 104*b* are distributed along the circumferential direction or the angular coordinate direction, respectively. In this way, in the present embodiment, the shapes of the first groove 104*a* and the second groove 104*b* are respectively circular. That is, in the present embodiment, the surface pattern 104 includes the first grooves 104*a* and the second grooves 104*b* having the same shape distribution. In addition, as shown in FIG. 1, the distribution profile of the surface pattern 104 is a concentric ring. That is, in the present embodiment, the center of the circle of the first groove 104*a* overlaps the center of the polishing pad 100, and the center of the circle of the second groove 104*b* overlaps the center of the polishing pad 100.

In the present embodiment, the first groove 104*a* has a first cutting trajectory direction 1Da, and the second groove 104*b* has a second cutting trajectory direction 1Db. In one embodiment, when a cutting device is used to form a groove on the polishing surface of the polishing pad, the position of the cutting device is fixed, and the polishing pad is moved relative to the cutting device. At this time, the "cutting trajectory direction" can be defined as the direction opposite to the motion direction of the polishing pad when a cutting device is used to form a groove on the polishing surface of the polishing pad. For example, in the case that the shape of the groove to be formed is circular, when the polishing pad is moved counterclockwise to make the cutting device form a groove on the polishing surface, the cutting trajectory direction of the groove is a clockwise direction, and vice versa. In another embodiment, when a cutting device is used to form a groove on the polishing surface of the polishing pad, the position of the polishing pad is fixed, and the cutting device moves relative to the polishing pad. At this time, the "cutting trajectory direction" can be defined as the same direction as the motion direction of the cutting device when the cutting device is used to form a groove on the polishing surface of the polishing pad. For example, in the case that the shape of the groove to be formed is circular, when the cutting device moves clockwise to make the cutting device form a groove on the polishing surface, cutting trajectory direction of the groove is a clockwise direction, and vice versa.

As shown in FIG. 1, the first cutting trajectory direction 1Da is forward with the first coordinate direction 10*a*, and the second cutting trajectory direction 1Db is reverse with the first coordinate direction 10*a*. That is, in the present embodiment, the first cutting trajectory direction 1Da is opposite to the second cutting trajectory direction 1Db. In addition, as shown in FIG. 1, the first cutting trajectory direction 1Da is forward with the motion direction R, and the second cutting trajectory direction 1Db is reverse with the motion direction R. In detail, in the present embodiment, the motion direction R is a counterclockwise direction, the first cutting trajectory direction 1Da is a counterclockwise direction, and the second cutting trajectory direction 1Db is a clockwise direction. However, the present invention is not limited thereto, as long as the first cutting trajectory direction 1Da is opposite to the second cutting trajectory direction 1Db, it falls within the scope of the present invention. In other embodiments, when the motion direction R is a clockwise direction, the first cutting trajectory direction 1Da is a clockwise direction, and the second cutting trajectory direction 1Db is a counterclockwise direction.

In the present embodiment, the first grooves 104*a* and the second grooves 104*b* may be arranged alternately along the second coordinate direction 10*b*. As shown in FIG. 1, along the second coordinate direction 10*b* (i.e., the radial direction or the radial coordinate direction), the distribution arrangement of the surface pattern 104 is in order of the first groove 104*a*, the second groove 104*b*, the first groove 104*a*, and the second groove 104*b*. However, the present invention is not limited thereto, as long as the first grooves 104*a* and the second grooves 104*b* are arranged alternately (such as arranged alternately in a periodical manner or in a non-periodical manner) arranged alternately, they fall within the scope of the present invention. For example, in one embodiment, along the second coordinate direction 10*b* (i.e., the radial direction or the radial coordinate direction), the distribution arrangement of the surface pattern 104 may be in order of the first groove 104*a*, the first groove 104*a*, the second groove 104*b*, the first groove 104*a*, the first groove 104*a*, and the second groove 104*b*.

In addition, as shown in FIG. 1, each first groove 104*a* is disposed adjacent to the second groove 104*b*, and each second groove 104*b* is disposed adjacent to the first groove 104*a*. Specifically, the two first grooves 104*a* are spaced apart by the second groove 104*b*, and the two second grooves 104*b* are spaced apart by the first groove 104*a*. However, the present invention is not limited thereto, as long as there is one first groove 104*a* and one second groove 104*b* adjacent to each other in the surface pattern 104, it falls within the scope of the present invention. For example, as described above, along the second coordinate direction 10*b* (i.e., the radial direction or the radial coordinate direction), the distribution arrangement of the surface pattern 104 may be in order of the first groove 104*a*, the first groove 104*a*, the second groove 104*b*, the first groove 104*a*, the first groove 104*a*, and the second groove 104*b*, that is, the two first grooves 104*a* may also be selected to be adjacent to each other.

It is worth noting that, in the present embodiment, the polishing pad 100 satisfies the following conditions that: the first groove 104*a* has the first cutting trajectory direction 1Da, the second groove 104*b* has the second cutting trajectory direction 1Db, and the first cutting trajectory direction 1Da is opposite to the second cutting trajectory direction 1Db. In this way, when using the polishing pad 100 to perform the polishing procedure on the object, the polishing pad 100 can make the polishing fluid have different flow field distribution for the following reason.

When a cutting device is used to form a groove on the polishing surface of the polishing pad, the scraping effect between the cutting device and the polishing pad causes the sidewall of the groove to form many fine burrs that are tapered and tipped forward with the cutting trajectory direction. Therefore, a number of fine gaps are formed between these burrs, the width of each of the fine gaps changes from wide to narrow along a direction opposite to the cutting trajectory direction. In general, for the polishing procedure, the main components of various polishing fluid used in the industry include water, so during the polishing procedure of the object using the polishing pad, the polishing fluid enters the grooves along the fine gaps to induce the directional capillary phenomenon. As mentioned above, the width of the fine gap changes from wide to narrow in the opposite direction of the cutting trajectory direction, so the polishing fluid entering the grooves flows in the opposite direction of the cutting trajectory direction due to the action of the capillary phenomenon. In this way, during the polishing procedure of the object using the polishing pad 100, the polishing fluid entering the first groove 104*a* flows in the opposite direction of the first cutting trajectory direction 1Da, and the polishing fluid entering the second groove 104*b* flows in the opposite direction of the second cutting trajectory direction 1Db (i.e., the polishing fluid entering the first groove 104*a* flows oppositely to the polishing fluid entering the second groove 104*b*). However, the present invention is not limited thereto. For some polishing processes, the polishing fluid may have an overall flow direction on the polishing pad because of the configuration of the polishing equipment or the setting of the polishing parameters, but in any case, the polishing fluid that enters the grooves still be affected by the capillary phenomenon to induce a driving force in the opposite direction of the cutting trajectory direction (i.e., a resistance is induced along the cutting trajectory direction of the grooves), so that the polishing fluid has microscopically different flow field distribution. Therefore, the polishing pad 100 has grooves with different cutting trajectory directions, so that the polishing fluid has different flow field distribution.

In addition, in the present embodiment, the first groove 104*a* having the first cutting trajectory direction 1Da and the second groove 104*b* having the second cutting trajectory direction 1Db opposite to the first cutting trajectory direction 1Da are arranged alternately, thereby during the polishing procedure of the object using the polishing pad 100, the polishing pad 100 enables the polishing fluid to have different flow field distribution.

Figure 2:
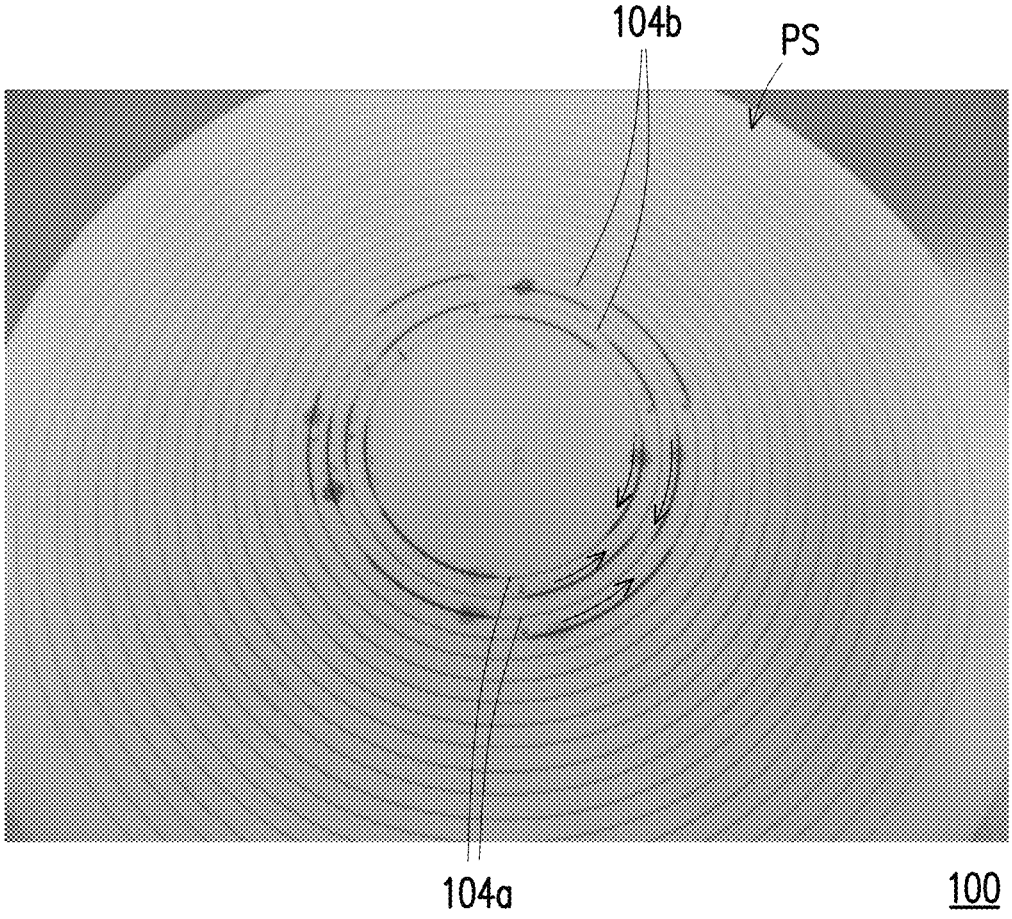
FIG. 2 is a photograph showing a flow trace after water droplets are dropped into the first groove and the second groove.

In the following, a drip experiment disclosed in FIG. 2 is used to illustrate that the first groove 104*a* has the first cutting trajectory direction 1Da, the second groove 104*b* has the second cutting trajectory direction 1Db, and the first cutting trajectory direction 1Da is opposite to the second cutting trajectory directions 1CDb, such that the polishing pad 100 makes the polishing fluid have different flow field distribution. FIG. 2 is a photograph showing a flow trace after water droplets are dripped into the first groove 104*a* and the second groove 104*b*. In the polishing pad 100 of FIG. 2, the first cutting trajectory direction 1Da of the first groove 104*a* is counterclockwise, and the second cutting trajectory direction 1Db of the second groove 104*b* is clockwise. It can be seen from FIG. 2 that after the water droplets are dripped into the first groove 104*a*, the water flows clockwise, that is, water flows in the opposite direction of the first cutting trajectory direction 1Da; and after the water droplets are dripped into the second groove 104*b*, the water flows counterclockwise, that is, water flows in the opposite direction of the second cutting trajectory direction 1Db. This result confirms that water entering the first groove 104*a* having the first cutting trajectory direction 1Da flows oppositely to water entering the second groove 104*b* having the second cutting trajectory direction 1Db opposite to the first cutting trajectory direction 1Da, so the polishing pad 100 makes the polishing fluid have different flow field distribution.

Figure 3:
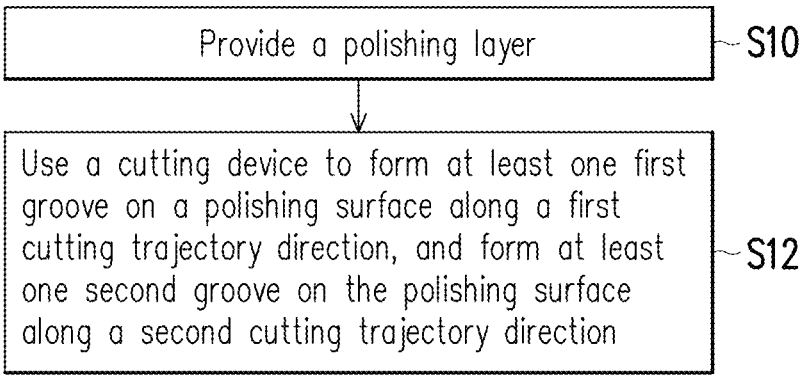
FIG. 3 is a flowchart of a method for manufacturing a polishing pad according to an embodiment of the present invention.
Figure 4:
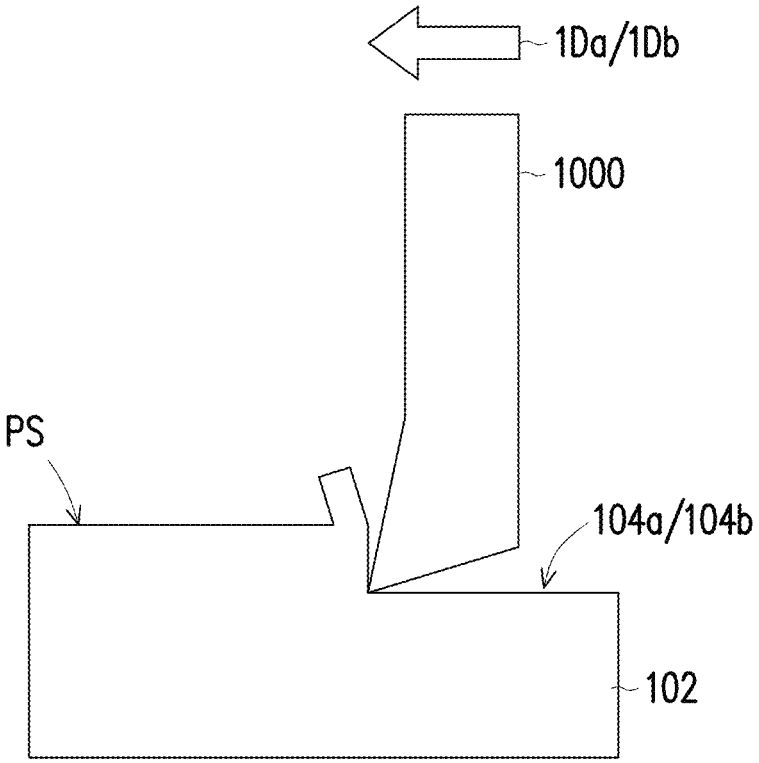
FIG. 4 is a schematic cross-sectional view of forming a first groove or a second groove using a cutting device in the process of manufacturing a polishing pad according to an embodiment of the present invention.

As described above, by forming the first groove 104*a* and the second groove 104*b* with opposite cutting trajectory directions, the polishing pad 100 makes the polishing fluid have different flow field distribution. In the following, in order to describe the polishing pad 100 and its effects more clearly, the manufacturing method of the polishing pad 100 will be described with reference to FIG. 3 and FIG. 4. FIG. 3 is a flowchart of a method of manufacturing a polishing pad according to an embodiment of the present invention. FIG. 4 is a schematic cross-sectional view of forming a first groove or a second groove using a cutting device in the process of manufacturing a polishing pad according to an embodiment of the present invention. It should be noted that FIG. 4 is a schematic cross-sectional view shown along the first cutting trajectory direction 1Da or the second cutting trajectory direction 1Db, and FIG. 4 reveals a part of the polishing layer 102 corresponding to one of the first groove 104*a* and the second groove 104*b*. In addition, the related content of the polishing pad 100 has been described in detail in the foregoing embodiment, so it is not repeated here, and the description of the omitted part can refer to the foregoing embodiment.

First, referring to both FIG. 1 and FIG. 3, in step S10, a polishing layer 102 having a polishing surface PS is provided. The related description of the polishing layer 102 has been described in detail in the foregoing embodiment, so it is not repeated here.

Then, referring to FIG. 1, FIG. 3 and FIG. 4, in step S12, a cutting device 1000 is used to form at least one first groove 104*a* on the polishing surface PS along a first cutting trajectory direction 1Da, and form at least one second groove 104*b* on the polishing surface PS along a second cutting trajectory directions 1Db. As mentioned above, in one embodiment, when a cutting device is used to form groove on the polishing surface PS, the position of the cutting device is fixed, and the polishing pad is moved relative to the cutting device. Based on this, in the present embodiment, during the first step of using the cutting device 1000 to form the at least one first groove 104*a* along the first cutting trajectory direction 1Da, the position of the cutting device 1000 is fixed, and the polishing pad 100 is moved in the opposite direction of the first cutting trajectory direction 1Da (i.e., a clockwise direction), and during the second step of using the cutting device 1000 to form the at least one second groove 104*b* along the second cutting trajectory direction 1Db, the position of the cutting device 1000 is fixed, and the polishing pad 100 is moved in the opposite direction of the second cutting trajectory direction 1Db (i.e., a counterclockwise direction). The first and second steps may be completed in different cutting equipment, where the first cutting equipment has a cutting platform rotating clockwise and the second cutting equipment has a cutting platform rotating counterclockwise. In addition, the first step and the second step may be completed in the same cutting equipment. In such case, during the first step, the cutting platform of the cutting equipment rotates clockwise, and during the second step, the cutting platform of the cutting equipment rotates counterclockwise, and before the second step is performed, the step of turning the cutting device (e.g., the cutting device 1000) 180 degree is included. However, the present invention is not limited thereto. In another embodiment, when a cutting device is used to form a groove on the polishing surface, the position of the polishing pad is fixed, and the cutting device is moved relative to the polishing pad to form the groove on the polished surface. The related descriptions of the at least one first groove 104*a* and the at least one second groove 104*b* have been described in detail in the foregoing embodiment, so they will not be repeated here.

In the present embodiment, the cutting device 1000 may include a cutter, such as a blade or a saw blade. In the present embodiment, the number of the cutter in the cutting device 1000 is not particularly limited, and can be adjusted according to the number of the first grooves 104*a* and the second grooves 104*b* to be formed and/or the cutting process requirements. For example, in one embodiment, the cutting device 1000 may include a single cutter, and each of the first grooves 104*a* and each of the second grooves 104*b* are formed in different cutting steps. For another example, in one embodiment, the cutting device 1000 may include two cutters adjacent to each other, and a distance between the two cutters is substantially two times of a distance between the first groove 104*a* and the second groove 104*b* adjacent to each other. In such case, two first grooves 104*a* are formed in the same cutting step, and two second grooves 104*b* are formed in the other cutting step. It is worth mentioning that when the cutting device 1000 includes two cutters, and a distance between the two cutters is substantially two times of a distance between the first groove 104*a* and the second groove 104*b* adjacent to each other, two first grooves 104*a* can be formed in the same cutting process and two second grooves 104*b* can be formed in the same cutting process. Therefore, compared with the embodiment in which the cutting device 1000 includes a single cutter, the embodiment in which the cutting device 1000 includes two cutters has the advantage of reduced process time. In addition, when the cutting device 1000 processes a groove on the polishing surface PS of the polishing pad 100, the linear velocity of the cutting processing point generated by the relative movement between the cutter and the polishing pad 100 ranges, for example, from 50 m/min to 500 m/min, which is easier to produce grooves with different cutting trajectory directions, so that the polishing fluid has different flow field distribution. The surface condition of the polishing surface after cutting by the cutting device has a corresponding relationship with the linear velocity of the cutting processing point. If the linear velocity of the cutting processing point is too fast, the fine burrs that are tapered and tipped forward with the cutting trajectory direction as described above will not easily be formed at the sidewall of the groove of the polishing pad, which makes the polishing pad difficult to reach grooves with different cutting trajectory directions to make the polishing fluid have different flow field distribution. On the other hand, if the linear velocity of the cutting processing point is too slow, the cutter may be damaged due to high resistance or the grooves formed may have poor dimensional uniformity.

In addition, as described above, the number of the first grooves 104*a* and the number of the second grooves 104*b* are not limited to two, and the number of the first grooves 104*a* and the number of the second grooves 104*b* may be respectively designed into three or more based on actual conditions as needed. Based on this, in other embodiments, the cutting device 1000 may include three or more than three cutters. In addition, as described above, the manner of the distribution arrangement of the surface pattern 104 is not limited to the first groove 104*a*, the second groove 104*b*, the first groove 104*a*, and the second groove 104*b* in order along the second coordinate direction 10*b*, as long as the first grooves 104*a* and the second grooves 104*b* are arranged alternately (such as arranged alternately in a periodical manner or in a non-periodical manner). Based on this, in other embodiments, a distance between two adjacent cutters in the cutting device 1000 may be substantially three times or more of a distance between the first groove 104*a* and the second groove 104*b* adjacent to each other. For example, in the embodiment that along the second coordinate direction 10*b*, the distribution arrangement of the surface pattern 104 is in order of the first groove 104*a*, the first groove 104*a*, the second groove 104*b*, the first groove 104*a*, the first groove 104*a* and the second groove 104*b*, four first grooves 104*a* may be formed in two cutting steps by the cutting device 1000, and two second grooves 104*b* may be formed in the same one cutting step by the cutting device 1000, the cutting device 1000 includes two cutters adjacent to each other, and a distance between the two cutters is substantially three times of a distance between the first groove 104*a* and the second groove 104*b* adjacent to each other. However, the present invention is not limited thereto. In other embodiments, the arrangement manner of the first grooves 104*a* and the second grooves 104*b* may be designed according to actual needs.

In the embodiment of FIG. 1, the shapes of the first groove 104*a* and the second groove 104*b* respectively are circular, but the present invention is not limited thereto. In other embodiments, the shapes of the first groove 104*a* and the second groove 104*b* may respectively be linear, irregular linear, elliptical ring, wavy ring, irregular ring, arc, elliptical arc, wavy arc, irregular arc, spiral, or a combination thereof. On the other hand, in the embodiment of FIG. 1, the distribution shape of the surface pattern 104 is concentric ring, but the present invention is not limited thereto. In other embodiments, the distribution shape of the surface pattern 104 may be parallel linear, non-parallel linear, XY grid, cross linear, eccentric ring, concentric elliptical ring, eccentric elliptical ring, wavy ring, irregular ring, radial linear, radial arc, concentric arc, eccentric arc, concentric elliptical arc, eccentric elliptical arc, wavy arc, irregular arc, spiral, or a combination thereof. Other variations of the polishing pad will be described in detail below with reference to FIG. 5 to FIG. 10.

Figure 5:
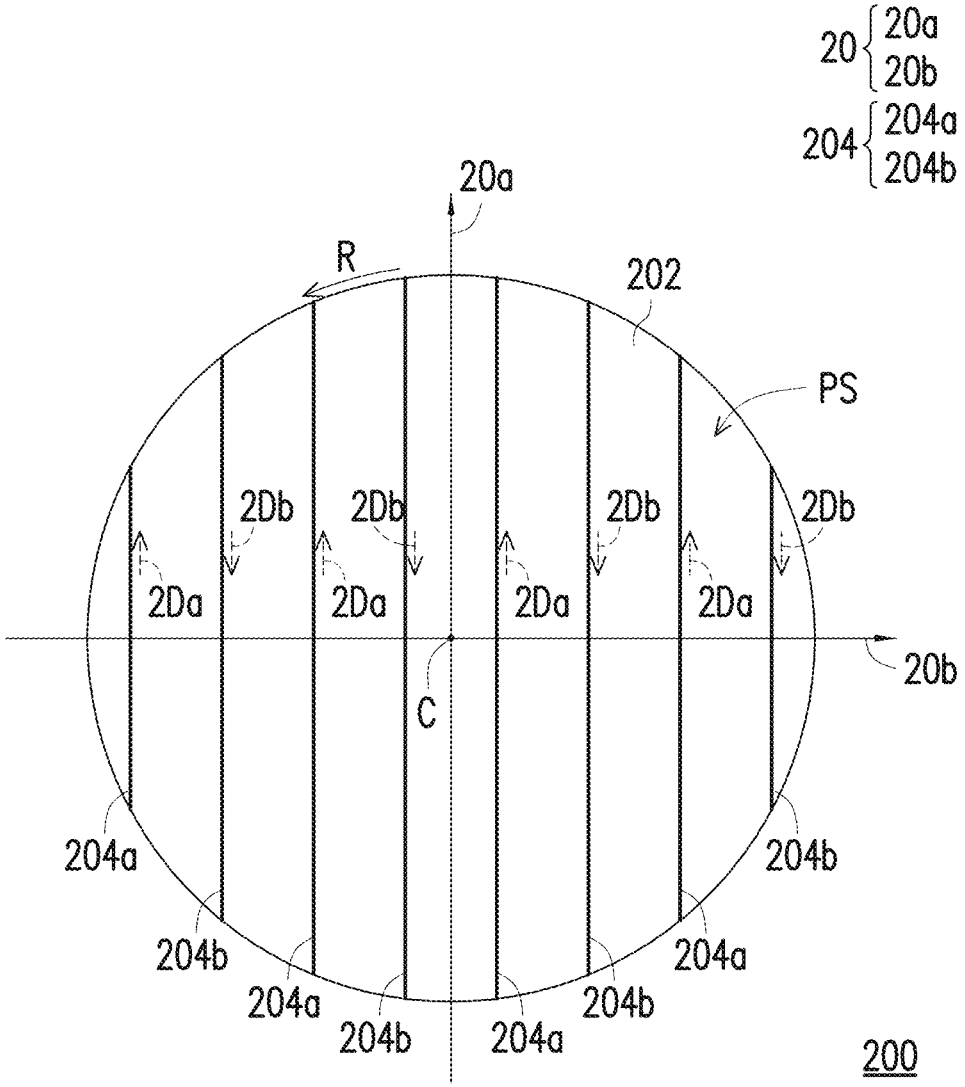
FIG. 5 is a schematic top view of a polishing pad according to another embodiment of the present invention.

FIG. 5 is a schematic top view of a polishing pad according to another embodiment of the present invention. Please refer to both FIG. 5 and FIG. 1, the polishing pad 200 in FIG. 5 is similar to the polishing pad 100 in FIG. 1, so the same or similar components are represented by the same or similar numerals, and the related descriptions are not repeated. It is worth mentioning that the polishing layer 202 and the surface pattern 204 are the same as or similar to the corresponding ones in the embodiment of FIG. 1 (that is, the polishing layer 102 and the surface pattern 104), so the related descriptions are not repeated here. The differences between the polishing pad 200 and the polishing pad 100 will be described below.

In the present embodiment, the polishing surface PS of the polishing layer 202 corresponds to a two-dimensional orthogonal coordinate system 20 having a first coordinate direction 20*a* and a second coordinate direction 20*b*. As shown in FIG. 5, the two-dimensional orthogonal coordinate system 20 is a rectangular coordinate system. Those skilled in the art should understand that the rectangular coordinate system is defined by the Y-axis and the X-axis, and the Y-axis and the X-axis are two vertical and horizontal number lines perpendicular to each other at 90 degrees, and the intersection point of the Y-axis and the X-axis is the original point of the rectangular coordinate system. In view of this, those skilled in the art should understand that the first coordinate direction 20*a* is a vertical direction, and the second coordinate direction 20*b* is a horizontal direction. In addition, those skilled in the art should understand that the upward direction of the Y-axis is a positive direction, and the rightward direction of the X-axis is a positive direction. Therefore, as shown in FIG. 5, the first coordinate direction 20*a* is also +Y-axis direction, and the second coordinate direction 20*b* is also +X-axis direction.

In the present embodiment, the rotating axis C of the polishing pad 200 corresponds to the original point of the two-dimensional orthogonal coordinate system 20, that is, the rotating axis C of the polishing pad 200 corresponds to the intersection point of the first coordinate direction 20*a* and the second coordinate direction 20*b*. In addition, as shown in FIG. 5, the rotating axis C is located at the center of the polishing pad 200. Taking the polishing pad 200 shown in FIG. 5 as a circle, the center of the polishing pad 200 is the center of the circle, that is, the rotating axis C is located at the center of the circle of the polishing pad 200. When the polishing procedure is performed on the object using the polishing pad 200, the polishing pad 200 is fixed on a polishing platen (not shown) of the polishing equipment, and the polishing pad 200 is driven by the polishing platen to rotate along the rotating axis C in the motion direction R. As shown in FIG. 5, with respect to the rotating axis C of the polishing pad 200 (i.e., the center of the polishing pad 200), the motion direction R is a counterclockwise direction, that is, the polishing pad 200 rotates in a counterclockwise direction, but the present invention is not limited thereto. In other embodiments, the motion direction R may also be a clockwise direction.

In the present embodiment, the surface pattern 204 may include at least one first groove 204*a* and at least one second groove 204*b*. As shown in FIG. 5, the at least one first groove 204*a* is exemplified by four first grooves 204*a*, and the at least one second groove 204*b* is exemplified by four second grooves 204*b*. However, the present invention is not limited thereto. The number of the first grooves 204*a* and the number of the second grooves 204*b* can be respectively designed to be one, two, three, or more than five according to actual needs.

In the present embodiment, the first grooves 204*a* and the second grooves 204*b* are respectively distributed along the first coordinate direction 20*a*. That is, in the present embodiment, the first grooves 204*a* and the second grooves 204*b* are respectively distributed along the vertical direction or the Y-axis direction, and the first grooves 204*a* and the second grooves 204*b* are respectively parallel to the first coordinate direction 20*a* (i.e., the vertical direction or the Y-axis direction). In this way, in the present embodiment, the shapes of the first groove 204*a* and the second groove 204*b* are linear. That is, in the present embodiment, the surface pattern 204 includes the first grooves 204*a* and the second grooves 204*b* having the same shape distribution. In addition, as shown in FIG. 5, the distribution profile of the surface pattern 204 is parallel linear. That is, in the present embodiment, the first groove 204*a* and the second groove 204*b* are disposed parallel to each other.

In the present embodiment, the first groove 204*a* has a first cutting trajectory direction 2Da, and the second groove 204*b* has a second cutting trajectory direction 2Db. In one embodiment, when a cutting device is used to form a groove on the polishing surface of the polishing pad, the position of the cutting device is fixed, and the polishing pad is moved relative to the cutting device. At this time, the "cutting trajectory direction" can be defined as the direction opposite to the motion direction of the polishing pad when a cutting device is used to form a groove on the polishing surface of the polishing pad. For example, in the case that the shape of the groove to be formed is linear, when the polishing pad is moved toward the +Y-axis direction to make the cutting device form a groove on the polishing surface, the cutting trajectory direction of the groove is −Y-axis direction, and vice versa. In another embodiment, when a cutting device is used to form a groove on the polishing surface of the polishing pad, the position of the polishing pad is fixed, and the cutting device moves relative to the polishing pad. At this time, the "cutting trajectory direction" can also be defined as the same direction as the motion direction of the cutting device when the cutting device is used to form a groove on the polishing surface of the polishing pad. For example, in the case that the shape of the groove to be formed is linear, when the cutting device is moved toward the +Y-axis direction so that the cutting device forms a groove on the polishing surface, the cutting trajectory direction of the groove is +Y-axis direction, and vice versa.

As shown in FIG. 5, the first cutting trajectory direction 2Da is forward with the first coordinate direction 20*a*, and the second cutting trajectory direction 2Db is reverse with the first coordinate direction 20*a*. That is, in the present embodiment, the first cutting trajectory direction 2Da is opposite to the second cutting trajectory direction 2Db. As mentioned above, the first coordinate direction 20*a* is the +Y-axis direction, so the first cutting trajectory direction 2Da is forward with the +Y-axis direction, and the second cutting trajectory direction 2Db is reverse with the +Y-axis direction. From another point of view, the first cutting trajectory direction 2Da is the +Y-axis direction, and the second cutting trajectory direction 2Db is the −Y-axis direction. However, the present invention is not limited thereto, as long as the first cutting trajectory direction 2Da is opposite to the second cutting trajectory direction 2Db, it falls within the scope of the present invention. In other embodiments, the first cutting trajectory direction 2Da may be the −Y-axis direction, and the second cutting trajectory direction 2Db may be the +Y-axis direction.

In the present embodiment, the first grooves 204*a* and the second grooves 204*b* may be arranged alternately along the second coordinate direction 20*b*. As shown in FIG. 5, along the second coordinate direction 20*b* (i.e., the horizontal direction or the X-axis direction), the distribution arrangement of the surface pattern 204 is in order of the first groove 204*a*, the second groove 204*b*, the first groove 204*a*, the second groove 204*b*, the first groove 204*a*, the second groove 204*b*, the first groove 204*a*, and the second groove 204*b*. However, the present invention is not limited thereto, as long as the first grooves 204*a* and the second grooves 204*b* are arranged alternately (such as arranged alternately in a periodical manner or in a non-periodical manner), they fall within the scope of the present invention. In other words, the number and the order of the grooves included in the surface pattern 204 can be adjusted according to actual needs. For example, in one embodiment, the distribution arrangement of the surface pattern 204 along the second coordinate direction 20*b* (i.e., the horizontal direction or the X-axis direction) may be in order of the first groove 204*a*, the first groove 204*a*, and the second groove 204*b*, the first groove 204*a*, the first groove 204*a*, and the second groove 204*b*. However, the present invention is not limited thereto. In other embodiments, the arrangement of the first grooves 204*a* and the second grooves 204*b* can be designed according to actual needs.

In addition, as shown in FIG. 5, each first groove 204*a* is disposed adjacent to the second groove 204*b*, and each second groove 204*b* is disposed adjacent to the first groove 204*a*. Specifically, two of the first grooves 204*a* are spaced apart by the corresponding second groove 204*b*, and two of the second grooves 204*b* are spaced apart by the corresponding first groove 204*a*. However, the present invention is not limited thereto, as long as there is one first groove 204*a* and one second groove 204*b* adjacent to each other in the surface pattern 204, it falls within the scope of the present invention. For example, as described above, along the second coordinate direction 20*b* (i.e., the horizontal direction or the X-axis direction), the distribution arrangement of the surface pattern 204 may be in order of the first groove 204*a*, the first groove 204*a*, the second groove 204*b*, the first groove 204*a*, the first groove 204*a*, and the second groove 204*b*, that is, two first grooves 204*a* may be selected to be adjacent to each other.

Based on the foregoing descriptions of FIG. 1 and FIG. 2, it can be known that in the present embodiment, the polishing pad 200 satisfies the following conditions that: the first groove 204*a* has the first cutting trajectory direction 2Da, the second groove 204*b* has the second cutting trajectory direction 2Db, and the first cutting trajectory direction 2Da is opposite to the second cutting trajectory direction 2Db, so that when the object is subjected to a polishing procedure using the polishing pad 200, the polishing pad 200 makes the polishing fluid have different flow field distribution.

In addition, in the present embodiment, the first grooves 204*a* having the first cutting trajectory direction 2Da and the second grooves 204*b* having the second cutting trajectory direction 2Db opposite to the first cutting trajectory direction 2Da are arranged alternately, thereby during the polishing procedure of the object using the polishing pad 200, the polishing pad 200 enables the polishing fluid to have different flow field distribution.

Figure 6:
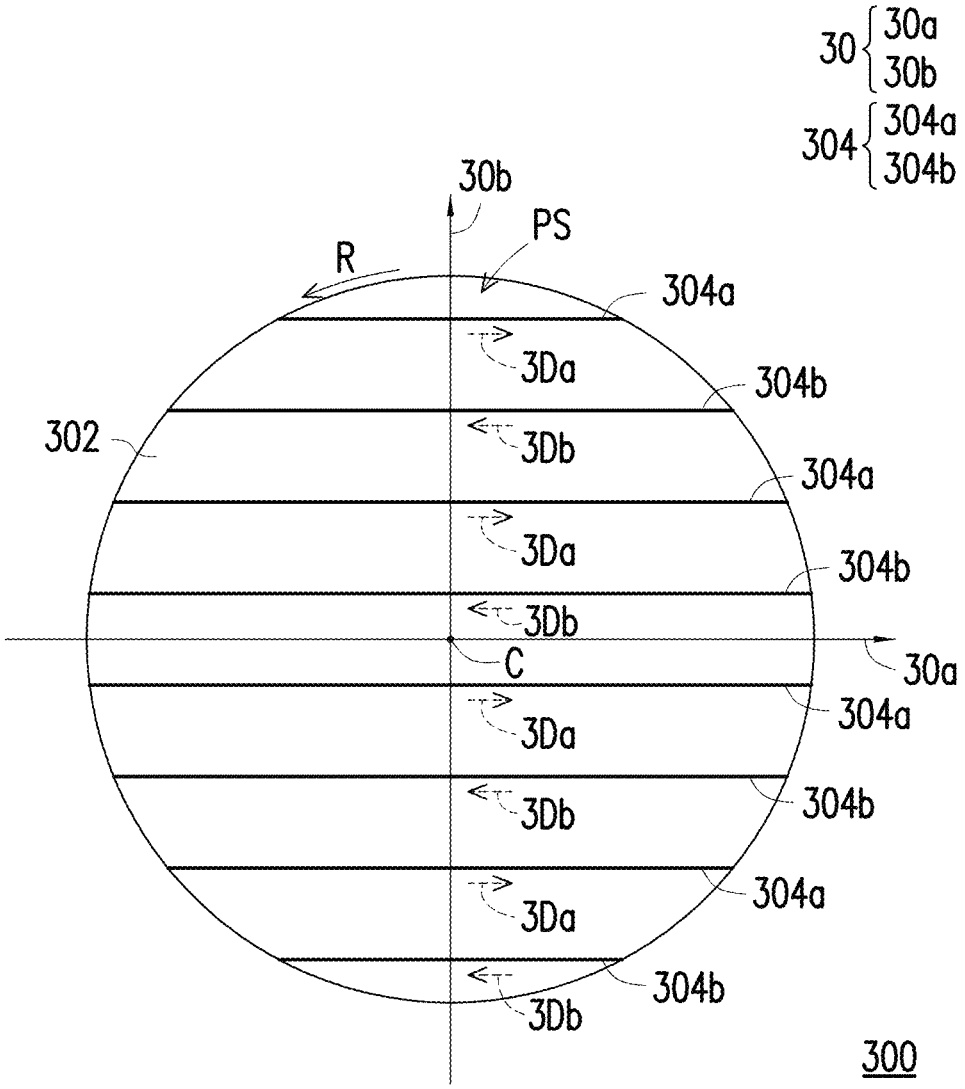
FIG. 6 is a schematic top view of a polishing pad according to another embodiment of the present invention.

FIG. 6 is a schematic top view of a polishing pad according to another embodiment of the present invention. Please refer to both FIG. 6 and FIG. 1, the polishing pad 300 in FIG. 6 is similar to the polishing pad 100 in FIG. 1, so the same or similar components are represented by the same or similar numerals, and the related descriptions are not repeated. It is worth mentioning that the polishing layer 302 and the surface pattern 304 are the same as or similar to the corresponding ones in the embodiment of FIG. 1 (that is, the polishing layer 102 and the surface pattern 104), so the related descriptions are not repeated again. The differences between the polishing pad 300 and the polishing pad 100 will be described below.

In the present embodiment, the polishing surface PS of the polishing layer 302 corresponds to a two-dimensional orthogonal coordinate system 30 having a first coordinate direction 30*a* and a second coordinate direction 30*b*. As shown in FIG. 6, the two-dimensional orthogonal coordinate system 30 is a rectangular coordinate system. Those skilled in the art should understand that the rectangular coordinate system is defined by the Y-axis and the X-axis, and the Y-axis and the X-axis are two vertical and horizontal number lines perpendicular to each other at 90 degrees, and the intersection point of the Y-axis and the X-axis is the original point of the rectangular coordinate system. In view of this, those skilled in the art should understand that the first coordinate direction 30*a* is a horizontal direction, and the second coordinate direction 30*b* is a vertical direction. In addition, those skilled in the art should understand that the upward direction of the Y-axis is a positive direction, and the rightward direction of the X-axis is a positive direction. Therefore, as shown in FIG. 6, the first coordinate direction 30*a* is also +X-axis direction, and the second coordinate direction 30*b* is also +Y-axis direction.

In the present embodiment, the rotating axis C of the polishing pad 300 corresponds to the original point of the two-dimensional orthogonal coordinate system 30, that is, the rotating axis C of the polishing pad 300 corresponds to the intersection point of the first coordinate direction 30*a* and the second coordinate direction 30*b*. In addition, as shown in FIG. 6, the rotating axis C is located at the center of the polishing pad 300. Taking the polishing pad 300 shown in FIG. 6 as a circle, the center of the polishing pad 300 is the center of the circle, that is, the rotating axis C is located at the center of the circle of the polishing pad 300. When the polishing procedure is performed on the object using the polishing pad 300, the polishing pad 300 is fixed on a polishing platen (not shown) of the polishing equipment, and the polishing pad 300 is driven by the polishing platen to rotate along the rotating axis C in the motion direction R. As shown in FIG. 6, with respect to the rotating axis C of the polishing pad 300 (i.e., the center of the polishing pad 300), the motion direction R is a counterclockwise direction, that is, the polishing pad 300 rotates in a counterclockwise direction but the present invention is not limited thereto. In other embodiments, the motion direction R may also be a clockwise direction.

In the present embodiment, the surface pattern 304 may include at least one first groove 304*a* and at least one second groove 304*b*. As shown in FIG. 6, the at least one first groove 304*a* is exemplified by four first grooves 304*a*, and the at least one second groove 304*b* is exemplified by four second grooves 304*b*. However, the present invention is not limited thereto. The number of the first grooves 304*a* and the number of the second grooves 304*b* can be respectively designed to be one, two, three, or more than five according to actual needs.

In the present embodiment, the first grooves 304*a* and the second grooves 304*b* are respectively distributed along the first coordinate direction 30*a*. That is, in the present embodiment, the first grooves 304*a* and the second grooves 304*b* are respectively distributed along the horizontal direction or the X-axis direction, and the first grooves 304*a* and the second grooves 304*b* are parallel to the first coordinate direction 30*a* (i.e., the horizontal direction or the X-axis direction), respectively. In this way, in the present embodiment, the shapes of the first groove 304*a* and the second groove 304*b* are linear. That is, in the present embodiment, the surface pattern 304 includes the first grooves 304*a* and the second grooves 304*b* having the same shape distribution. In addition, as shown in FIG. 6, the distribution profile of the surface pattern 304 is parallel linear. That is, in the present embodiment, the first groove 304*a* and the second groove 304*b* are disposed in parallel with each other.

In the present embodiment, the first groove 304*a* has a first cutting trajectory direction 3Da, and the second groove 304*b* has a second cutting trajectory direction 3Db. In one embodiment, when a cutting device is used to form a groove on the polishing surface of the polishing pad, the position of the cutting device is fixed, and the polishing pad is moved relative to the cutting device. At this time, the "cutting trajectory direction" can be defined as the direction opposite to the motion direction of the polishing pad when a cutting device is used to form a groove on the polishing surface of the polishing pad. For example, in the case that the shape of the groove to be formed is linear, when the polishing pad is moved toward the +X-axis direction so that the cutting device forms a groove on the polishing surface, the cutting trajectory direction of the groove is −X-axis direction, and vice versa. In another embodiment, when a cutting device is used to form a groove on the polishing surface of the polishing pad, the position of the polishing pad is fixed, and the cutting device moves relative to the polishing pad. At this time, the "cutting trajectory direction" can also be defined as the same direction as the motion direction of the cutting device when the cutting device is used to form a groove on the polishing surface of the polishing pad. For example, in the case that the shape of the groove to be formed is linear, when the cutting device is moved toward the +X-axis direction so that the cutting device forms a groove on the polishing surface, the cutting trajectory direction of the groove is +X-axis direction, and vice versa.

As shown in FIG. 6, the first cutting trajectory direction 3Da is forward with the first coordinate direction 30*a*, and the second cutting trajectory direction 3Db is reverse with the first coordinate direction 30*a*. That is, in the present embodiment, the first cutting trajectory direction 3Da is opposite to the second cutting trajectory direction 3Db. As mentioned above, the first coordinate direction 30*a* is the +X-axis direction, so the first cutting trajectory direction 3Da is forward with the +X-axis direction, and the second cutting trajectory direction 3Db is reverse with the +X-axis direction. From another perspective, the first cutting trajectory direction 3Da is the +X-axis direction, and the second cutting trajectory direction 3Db is the −X-axis direction. However, the present invention is not limited thereto, as long as the first cutting trajectory direction 3Da is opposite to the second cutting trajectory direction 3Db, it falls within the scope of the present invention. In other embodiments, the first cutting trajectory direction 3Da may be the −X-axis direction, and the second cutting trajectory direction 3Db may be the +X-axis direction.

In the present embodiment, the first grooves 304*a* and the second grooves 304*b* may be arranged alternately along the second coordinate direction 30*b*. As shown in FIG. 6, along the second coordinate direction 30*b* (i.e., the vertical direction or the Y-axis direction), the distribution arrangement of the surface pattern 304 is in order of the second groove 304*b*, the first groove 304*a*, the second groove 304*b*, the first groove 304*a*, the second groove 304*b*, the first groove 304*a*, the second groove 304*b*, and the first groove 304*a*. However, the present invention is not limited thereto, as long as the first grooves 304*a* and the second grooves 304*b* are arranged alternately (such as arranged alternately in a periodical manner or in a non-periodical manner), they fall within the scope of the present invention. In other words, the number and the order of the grooves included in the surface pattern 304 can be adjusted according to actual needs. For example, in one embodiment, the distribution arrangement of the surface pattern 304 along the second coordinate direction 30*b* (i.e., the vertical direction or the Y-axis direction) may be in order of the first groove 304*a*, the first groove 304*a*, the second groove 304*b*, the first groove 304*a*, the first groove 304*a*, and the second groove 304*b*. However, the present invention is not limited thereto. In other embodiments, the arrangement of the first grooves 304*a* and the second grooves 304*b* can be designed according to actual needs.

In addition, as shown in FIG. 6, each first groove 304*a* is disposed adjacent to the second groove 304*b*, and each second groove 304*b* is disposed adjacent to the first groove 304*a*. Specifically, two of the first grooves 304*a* are spaced by the corresponding second groove 304*b*, and two of the second grooves 304*b* are spaced by the corresponding first groove 304*a*. However, the present invention is not limited thereto, as long as there is one first groove 304*a* and one second groove 304*b* adjacent to each other in the surface pattern 304, it falls within the scope of the present invention. For example, as described above, along the second coordinate direction 30*b* (i.e., the vertical direction or the Y-axis direction), the distribution arrangement of the surface pattern 304 may be in order of the first groove 304*a*, the first groove 304*a*, the second groove 304*b*, the first groove 304*a*, the first groove 304*a*, and the second groove 304*b*, that is, two first grooves 304*a* may be selected to be adjacent to each other.

Based on the foregoing descriptions of FIG. 1 and FIG. 2, it can be known that in the present embodiment, the polishing pad 300 satisfies the following conditions that: the first groove 304*a* has the first cutting trajectory direction 3Da, the second groove 304*b* has the second cutting trajectory direction 3Db, and the first cutting trajectory direction 3Da is opposite to the second cutting trajectory direction 3Db, so that when the polishing procedure is performed on the object using the polishing pad 300, the polishing pad 300 makes the polishing fluid have different flow field distribution.

In addition, in the present embodiment, the first grooves 304*a* having the first cutting trajectory direction 3Da and the second grooves 304*b* having the second cutting trajectory direction 3Db opposite to the first cutting trajectory direction 3Da are arranged alternately, thereby during the polishing procedure of the object using the polishing pad 300, the polishing pad 300 enables the polishing fluid to have different flow field distribution.

In particular, the polishing pad in another embodiment of the present invention may have the above-mentioned surface pattern 204 in FIG. 5 and the above-mentioned surface pattern 304 in FIG. 6, so the distribution profile of the surface pattern of the said polishing pad is XY grid. The related descriptions and features have been shown in FIG. 5 and FIG. 6, which are not repeated here. It is also mentioned that during the polishing procedure of the object using a polishing pad having an XY grid surface pattern, through two sets of grooves crossing each other, the transmission efficiency of the polishing fluid on the polishing pad can be improved.

Figure 7:
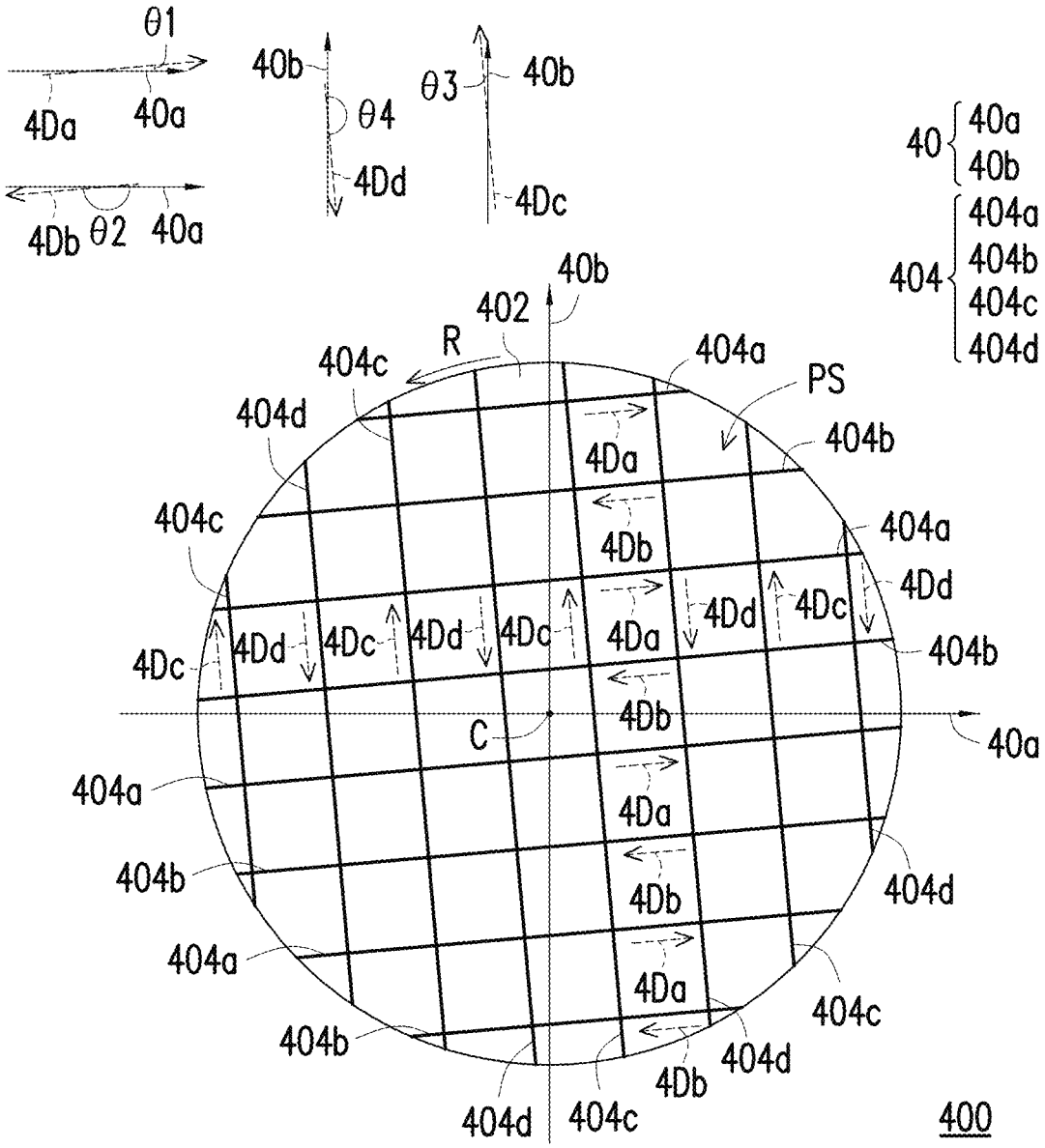
FIG. 7 is a schematic top view of a polishing pad according to another embodiment of the present invention.

FIG. 7 is a schematic top view of a polishing pad according to another embodiment of the present invention. Please refer to both FIG. 7 and FIG. 1, the polishing pad 400 in FIG. 7 is similar to the polishing pad 100 in FIG. 1, so the same or similar components are represented by the same or similar numerals, and the related descriptions are not repeated. It is worth mentioning that the polishing layer 402 and the surface pattern 404 are the same as or similar to the corresponding ones in the embodiment of FIG. 1 (i.e., the polishing layer 102 and the surface pattern 104), so the related descriptions are not repeated here. The differences between the polishing pad 400 and the polishing pad 100 will be described below.

In the present embodiment, the polishing surface PS of the polishing layer 402 corresponds to a two-dimensional orthogonal coordinate system 40 having a first coordinate direction 40*a* and a second coordinate direction 40*b*. As shown in FIG. 7, the two-dimensional orthogonal coordinate system 40 is a rectangular coordinate system. Those skilled in the art should understand that the rectangular coordinate system is defined by the Y-axis and the X-axis, and the Y-axis and the X-axis are two vertical and horizontal number lines perpendicular to each other at 90 degrees, and the intersection point of the Y-axis and the X-axis is the original point of the rectangular coordinate system. In view of this, those skilled in the art should understand that the first coordinate direction 40*a* is a horizontal direction, and the second coordinate direction 40*b* is a vertical direction. In addition, those skilled in the art should understand that the upward direction of the Y-axis is a positive direction, and the rightward direction of the X-axis is a positive direction. Therefore, as shown in FIG. 7, the first coordinate direction 40*a* is also +X-axis direction, and the second coordinate direction 40*b* is also +Y-axis direction.

In the present embodiment, the rotating axis C of the polishing pad 400 corresponds to the original point of the two-dimensional orthogonal coordinate system 40, that is, the rotating axis C of the polishing pad 400 corresponds to the intersection point of the first coordinate direction 40*a* and the second coordinate direction 40*b*. In addition, as shown in FIG. 7, the rotating axis C is located at the center of the polishing pad 400. Taking the polishing pad 400 shown in FIG. 7 as a circle, the center of the polishing pad 400 is the center of the circle, that is, the rotating axis C is located at the center of the circle of the polishing pad 400. When the polishing pad 400 is used to perform the polishing procedure on the object, the polishing pad 400 is fixed on a polishing platen (not shown) of the polishing equipment, and the polishing pad 400 is driven by the polishing platen to rotate along the rotating axis C in the motion direction R. As shown in FIG. 7, with respect to the rotating axis C of the polishing pad 400 (i.e., the center of the polishing pad 400), the motion direction R is a counterclockwise direction, that is, the polishing pad 400 rotates in a counterclockwise direction, but the present invention is not limited thereto. In other embodiments, the motion direction R may also be a clockwise direction.

In the present embodiment, the surface pattern 404 may include at least one first groove 404*a*, at least one second groove 404*b*, at least one third groove 404*c*, and at least one fourth groove 404*d*. As shown in FIG. 7, the at least one first groove 404*a* is exemplified by four first grooves 404*a*, the at least one second groove 404*b* is exemplified by four second grooves 404*b*, the at least one third groove 404*c* is exemplified by four third grooves 404*c*, and the at least one fourth groove 404*d* is exemplified by four fourth grooves 404*d*. However, the present invention is not limited thereto. The number of the first grooves 404*a*, the number of the second grooves 404*b*, the number of the third grooves 404*c*, and the number of the fourth grooves 404*d* can be respectively designed to be one, two, three, or more than five according to actual needs.

In the present embodiment, the shapes of the first groove 404*a* and the second groove 404*b* are linear. That is, in the present embodiment, the surface pattern 404 includes the first grooves 404*a* and the second grooves 404*b* having the same shape distribution. In addition, as shown in FIG. 7, the first groove 404*a* and the second groove 404*b* are disposed parallel to each other.

In the present embodiment, the shapes of the third groove 404*c* and the fourth groove 404*d* are linear. That is, in the present embodiment, the surface pattern 404 includes the third grooves 404*c* and the fourth grooves 404*d* having the same shape distribution. In addition, as shown in FIG. 7, the third groove 404*c* and the fourth groove 404*d* are disposed in parallel with each other.

As shown in FIG. 7, the distribution profile of the surface pattern 404 is cross linear. That is, in the present embodiment, the first groove 404*a* and the second groove 404*b* are intersected with the third groove 404*c* and the fourth groove 404*d*, respectively.

In the present embodiment, the first groove 404*a* has a first cutting trajectory direction 4Da, the second groove 404*b* has a second cutting trajectory direction 4Db, the third groove 404*c* has a third cutting trajectory direction 4Dc, and the fourth groove 404*d* has a fourth cutting trajectory direction 4Dd. In one embodiment, when a cutting device is used to form a groove on the polishing surface of the polishing pad, the position of the cutting device is fixed, and the polishing pad is moved relative to the cutting device. At this time, the "cutting trajectory direction" can be defined as the direction opposite to the motion direction of the polishing pad when a cutting device is used to form a groove on the polishing surface of the polishing pad. In another embodiment, when a cutting device is used to form a groove on the polishing surface of the polishing pad, the position of the polishing pad is fixed, and the cutting device moves relative to the polishing pad. At this time, the "cutting trajectory direction" can also be defined as the same direction as the motion direction of the cutting device when the cutting device is used to form a groove on the polishing surface of the polishing pad.

As shown in FIG. 7, the first cutting trajectory direction 4Da of the first groove 404*a* is forward with the first coordinate direction 40*a*, and the second cutting trajectory direction 4Db of the second groove 404*b* is reverse with the first coordinate direction 40*a*. That is, in the present embodiment, the first cutting trajectory direction 4Da is opposite to the second cutting trajectory direction 4Db. As mentioned above, the first coordinate direction 40*a* is the +X-axis direction, so the first cutting trajectory direction 4Da is forward with the +X-axis direction and the second cutting trajectory direction 4Db is reverse with the +X-axis direction. However, the present invention is not limited thereto, as long as the first cutting trajectory direction 4Da is opposite to the second cutting trajectory direction 4Db, it falls within the scope of the present invention. In other embodiments, the first cutting trajectory direction 4Da may be reverse with the +X-axis direction, and the second cutting trajectory direction 4Db may be forward with the +X-axis direction.

In addition, as shown in FIG. 7, the third cutting trajectory direction 4Dc of the third groove 404*c* is forward with the second coordinate direction 40*b*, and the fourth cutting trajectory direction 4Dd of the fourth groove 404*d* is reverse with the second coordinate direction 40*b*. That is, in the present embodiment, the third cutting trajectory direction 4Dc is opposite to the fourth cutting trajectory direction 4Dd. As mentioned above, the second coordinate direction 40*b* is the +Y-axis direction, so the third cutting trajectory direction 4Dc is forward with the +Y-axis direction, and the fourth cutting trajectory direction 4Dd is reverse with the +Y-axis direction. However, the present invention is not limited thereto, as long as the third cutting trajectory direction 4Dc is opposite to the fourth cutting trajectory direction 4Dd, it falls within the scope of the present invention. In other embodiments, the third cutting trajectory direction 4Dc may be reverse with the +Y-axis direction, and the fourth cutting trajectory direction 4Dd may be forward with the +Y-axis direction.

In addition, as shown in FIG. 7, a first included angle θ1 is between the first cutting trajectory direction 4Da of the first groove 404*a* and the first coordinate direction 40*a*, and a second included angle θ2 is between the second cutting trajectory direction 4Db of the second groove 404*b* and the first coordinate direction 40*a*. In the present embodiment, the first included angle θ1 is less than about 45 degrees and greater than or equal to about 0 degrees, and the second included angle θ2 is greater than about 135 degrees and less than or equal to about 180 degrees. A third included angle θ3 is between the third cutting trajectory direction 4Dc of the third groove 404*c* and the second coordinate direction 40*b*, and a fourth included angle θ4 is between the fourth cutting trajectory direction 4Dd of the fourth groove 404*d* and the second coordinate direction 40*b*. In the present embodiment, the third included angle θ3 is less than about 45 degrees and greater than or equal to about 0 degrees, and the fourth included angle θ4 is greater than about 135 degrees and less than or equal to about 180 degrees.

It is worth mentioning that, in one embodiment, when the first included angle θ1 plus the second included angle θ2 is equal to 180 degrees, the third included angle θ3 plus the fourth included angle θ4 is equal to 180 degrees, and the first included angle θ1 is equal to the third included angle θ3 (for example, the first included angle θ1 is equal to 0 degrees, the second included angle θ2 is equal to 180 degrees, the third included angle θ3 is equal to 0 degrees, and the fourth included angle θ4 is equal to 180 degrees), the distribution profile of the surface pattern 404 of the polishing pad 400 is cross linear with square shape (i.e., an XY grid shape). In other embodiments, the distribution profile of the surface pattern 404 of the polishing pad 400 may be cross linear with rhombus shape or other shapes.

In the present embodiment, the first grooves 404*a* and the second grooves 404*b* may be arranged alternately along the second coordinate direction 40*b*. As shown in FIG. 7, along the second coordinate direction 40*b* (i.e., the vertical direction or the Y-axis direction), the distribution arrangement of the surface pattern 404 is in order of the second groove 404*b*, the first groove 404*a*, the second groove 404*b*, the first groove 404*a*, the second groove 404*b*, the first groove 404*a*, the second groove 404*b*, and the first groove 404*a*. However, the present invention is not limited thereto, as long as the first grooves 404*a* and the second grooves 404*b* are arranged alternately (such as arranged alternately in a periodical manner or in a non-periodical manner), they fall within the scope of the present invention. In other words, the number and the order of the grooves included in the surface pattern 404 can be adjusted according to actual needs. For example, in one embodiment, the distribution arrangement of the surface pattern 404 along the second coordinate direction 40*b* (i.e., the vertical direction or the Y-axis direction) may be in order of the first groove 404*a*, the first groove 404*a*, the second groove 404*b*, the first groove 404*a*, the first groove 404*a*, and the second groove 404*b*. However, the present invention is not limited thereto. In other embodiments, the arrangement of the first grooves 404*a* and the second grooves 404*b* can be designed according to actual needs.

In addition, in the present embodiment, the third grooves 404*c* and the fourth grooves 404*d* may be arranged alternately along the first coordinate direction 40*a*. As shown in FIG. 7, along the first coordinate direction 40*a* (i.e., the horizontal direction or the X-axis direction), the distribution arrangement of the surface pattern 404 is in order of the third groove 404*c*, the fourth groove 404*d*, the third groove 404*c*, the fourth groove 404*d*, the third groove 404*c*, the fourth groove 404*d*, the third groove 404*c*, and the fourth groove 404*d*. However, the present invention is not limited thereto, as long as the third grooves 404*c* and the fourth grooves 404*d* are arranged alternately (such as arranged alternately in a periodical manner or in a non-periodical manner), they fall within the scope of the present invention. In other words, the number and the order of the grooves included in the surface pattern 404 can be adjusted according to actual needs. For example, in one embodiment, the distribution arrangement of the surface pattern 404 along the first coordinate direction 40*a* (i.e., the horizontal direction or the X-axis direction) may be in order of the third groove 404*c*, the third groove 404*c*, the fourth groove 404*d*, the third groove 404*c*, the third groove 404*c*, and the fourth groove 404*d*. However, the present invention is not limited thereto. In other embodiments, the arrangement of the third grooves 404*c* and the fourth grooves 404*d* can be designed according to actual needs.

As shown in FIG. 7, each first groove 404*a* is disposed adjacent to the second groove 404*b*, and each second groove 404*b* is disposed adjacent to the first groove 404*a*. Specifically, two of the first grooves 404*a* are spaced by the corresponding second groove 404*b*, and two of the second grooves 404*b* are spaced by the corresponding first groove 404*a*. However, the present invention is not limited thereto, as long as there is one first groove 404*a* and one second groove 404*b* adjacent to each other in the surface pattern 404, it falls within the scope of the present invention. For example, as described above, along the second coordinate direction 40*b* (i.e., the vertical direction or the Y-axis direction), the distribution arrangement of the surface pattern 404 may be in order of the first groove 404*a*, the first groove 404*a*, the second groove 404*b*, the first groove 404*a*, the first groove 404*a*, and the second groove 404*b*, that is, two first grooves 404*a* may be selected to be adjacent to each other.

As shown in FIG. 7, each third groove 404*c* is disposed adjacent to the fourth groove 404*d*, and each fourth groove 404*d* is disposed adjacent to the third groove 404*c*. Specifically, two of the third grooves 404*c* are spaced apart by the corresponding fourth groove 404*d*, and two of the fourth grooves 404*d* are spaced apart by the corresponding third groove 404*c*. However, the present invention is not limited thereto, as long as one third groove 404*c* and one fourth groove 404*d* are disposed adjacent to each other in the surface pattern 404, it falls within the scope of the present invention. For example, as described above, along the first coordinate direction 40*a* (i.e., the horizontal direction or the X-axis direction), the distribution arrangement of the surface pattern 404 may be in order of the third groove 404*c*, the third groove 404*c*, the fourth groove 404*d*, the third groove 404*c*, the third groove 404*c*, and the fourth groove 404*d*, that is, two third grooves 404*c* may be selected to be adjacent to each other.

Based on the foregoing descriptions of FIG. 1 and FIG. 2, it can be known that in the present embodiment, the polishing pad 400 satisfies the following conditions that: the first groove 404*a* has the first cutting trajectory direction 4Da, the second groove 404*b* has the second cutting trajectory direction 4Db, and the first cutting trajectory direction 4Da is opposite to the second cutting trajectory direction 4Db; and the third groove 404*c* has the third cutting trajectory direction 4Dc, the fourth groove 404*d* has the fourth cutting trajectory direction 4Dd, and the third cutting trajectory direction 4Dc is opposite to the fourth cutting trajectory direction 4Dd, so that when the object is subjected to a polishing procedure using the polishing pad 400, the polishing pad 400 enables the polishing fluid to have different flow field distribution.

In addition, in the present embodiment, the first grooves 404*a* having the first cutting trajectory direction 4Da and the second grooves 404*b* having the second cutting trajectory direction 4Db opposite to the first cutting trajectory direction 4Da are arranged alternately; and the third groove 404*c* having the third cutting trajectory direction 4Dc and the fourth groove 404*d* having the fourth cutting trajectory direction 4Dd opposite to the third cutting trajectory direction 4Dc are arranged alternately, thereby during the polishing procedure of the object using the polishing pad 400, the polishing pad 400 enables the polishing fluid to have different flow field distribution.

In addition, in the present embodiment, the distribution profile of the surface pattern 404 is formed to be cross linear by crossing the first grooves 404*a* and the second grooves 404*b* that are parallel to each other and the third grooves 404*c* and the fourth grooves 404*d* that are parallel to each other, thereby during the polishing procedure of the object using the polishing pad 400, the transmission efficiency of the polishing fluid on the polishing pad 400 can be improved. That is to say, in the present embodiment, the polishing pad 400 includes two sets of grooves that cross with each other (that is, the first grooves 404*a* and the second grooves 404*b* along with the third grooves 404*c* and the fourth grooves 404*d*), thereby the transmission efficiency of the polishing fluid on the polishing pad 400 can be improved.

Figure 8:
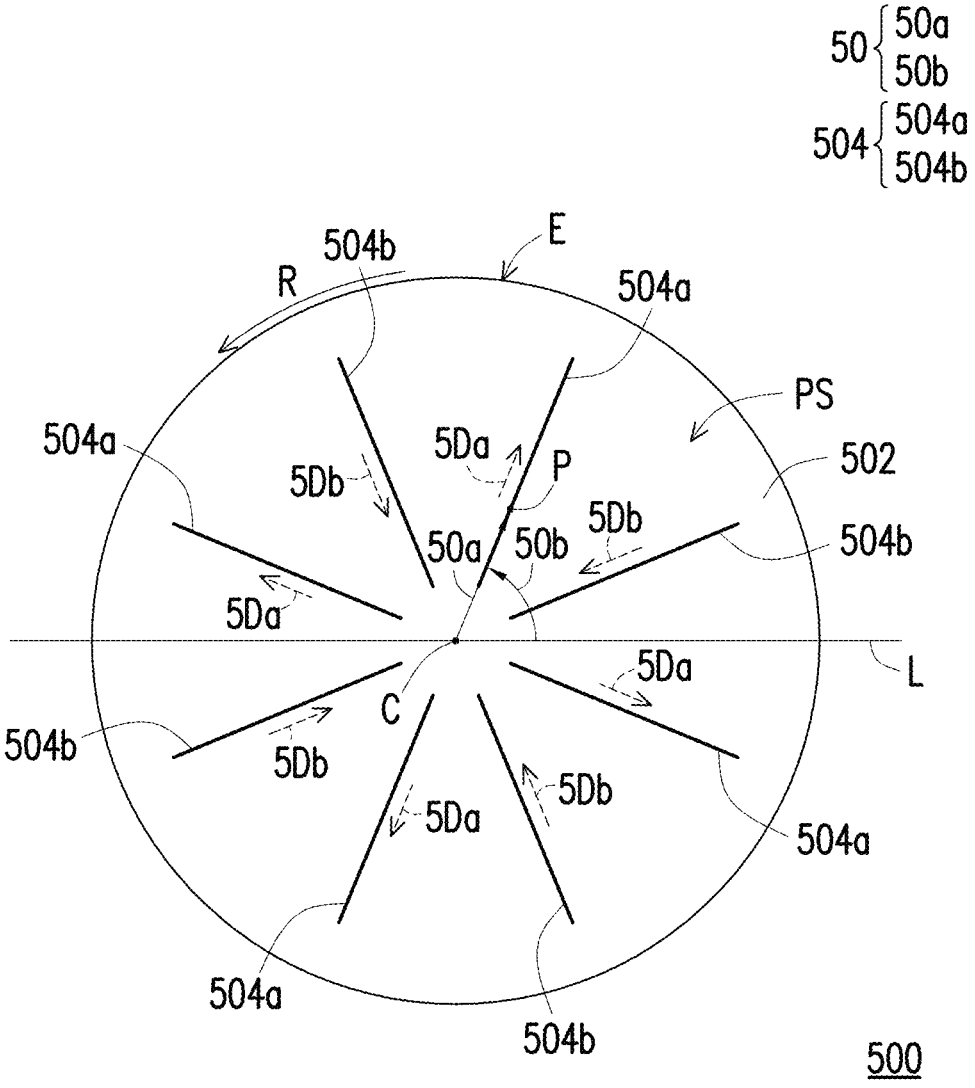
FIG. 8 is a schematic top view of a polishing pad according to another embodiment of the present invention.

FIG. 8 is a schematic top view of a polishing pad according to another embodiment of the present invention. Please refer to both FIG. 8 and FIG. 1, the polishing pad 500 in FIG. 8 is similar to the polishing pad 100 in FIG. 1, so the same or similar components are represented by the same or similar numerals, and the related descriptions are not repeated. It is worth mentioning that the polishing layer 502 and the surface pattern 504 are the same as or similar to the corresponding ones in the embodiment of FIG. 1 (that is, the polishing layer 102 and the surface pattern 104), so the related descriptions are not repeated here. The differences between the polishing pad 500 and the polishing pad 100 will be described below.

In the present embodiment, the polishing surface PS of the polishing layer 502 corresponds to a two-dimensional orthogonal coordinate system 50 having a first coordinate direction 50*a* and a second coordinate direction 50*b*. As shown in FIG. 8, the two-dimensional orthogonal coordinate system 50 is a polar coordinate system, the first coordinate direction 50*a* is a radial coordinate direction, and the second coordinate direction 50*b* is an angular coordinate direction. Those skilled in the art should understand that the radial coordinate represents the distance from the original point of the two-dimensional orthogonal coordinate system 50 to the pole P, and the angular coordinate represents the angular arc of the connection line between the pole P and the original point of the two-dimensional orthogonal coordinate system 50 with respect to the polar axis L in a counterclockwise direction, and the polar axis L is the X-axis in the rectangular coordinate system. In view of this, those skilled in the art should understand that the first coordinate direction 50*a* is also the radial direction, and the second coordinate direction 50*b* is also the circumferential direction. In addition, since the angular coordinate represents the angular arc of the connection line between the pole P and the original point of the two-dimensional orthogonal coordinate system 50 in a counterclockwise direction with respect to the polar axis L, the first coordinate direction 50*a* (i.e., the angular coordinate direction) is a counterclockwise direction.

In the present embodiment, the rotating axis C of the polishing pad 500 corresponds to the original point of the two-dimensional orthogonal coordinate system 50. In addition, as shown in FIG. 8, the rotating axis C is located at the center of the polishing pad 500. Taking the polishing pad 500 shown in FIG. 8 as a circle, the center of the polishing pad 500 is the center of the circle, that is, the rotating axis C is located at the center of the circle of the polishing pad 500. When the polishing procedure is performed on the object using the polishing pad 500, the polishing pad 500 is fixed on a polishing platen (not shown) of the polishing equipment, and the polishing pad 500 is driven by the polishing platen to rotate along the rotating axis C in the motion direction R. As shown in FIG. 8, with respect to the rotating axis C of the polishing pad 500 (i.e., the center of the polishing pad 500), the motion direction R is a counterclockwise direction, that is, the polishing pad 500 rotates in a counterclockwise direction, but the present invention is not limited thereto. In other embodiments, the motion direction R may also be a clockwise direction.

In the present embodiment, the surface pattern 504 may include at least one first groove 504*a* and at least one second groove 504*b*. As shown in FIG. 8, the at least one first groove 504*a* is exemplified by four first grooves 504*a*, and the at least one second groove 504*b* is exemplified by four second grooves 504*b*. However, the present invention is not limited thereto. The number of the first grooves 504*a* and the number of the second grooves 504*b* can be respectively designed to be one, two, three, or more than five according to actual needs.

In the present embodiment, the first grooves 504*a* and the second grooves 504*b* are respectively distributed along the first coordinate direction 50*a*. That is, in the present embodiment, the first grooves 504*a* and the second grooves 504*b* are respectively distributed along the radial direction or the radial coordinate direction. In this way, in the present embodiment, the shapes of the first grooves 504*a* and the second grooves 504*b* are linear. That is, in the present embodiment, the surface pattern 504 includes first grooves 504*a* and second grooves 504*b* having the same shape distribution. In addition, as shown in FIG. 8, the distribution profile of the surface pattern 504 is radial linear. That is, in the present embodiment, the first groove 504*a* and the second groove 504*b* are radially extending grooves, respectively, and the first groove 504*a* and the second groove 504*b* are radially distributed outward with respect to the center of the polishing pad 500.

In the present embodiment, the first groove 504*a* has a first cutting trajectory direction 5Da, and the second groove 504*b* has a second cutting trajectory direction 5Db. In one embodiment, when a cutting device is used to form a groove on the polishing surface of the polishing pad, the position of the cutting device is fixed, and the polishing pad is moved relative to the cutting device. At this time, the "cutting trajectory direction" can be defined as the direction opposite to the motion direction of the polishing pad when a cutting device is used to form a groove on the polishing surface of the polishing pad. For example, in the case of forming a radially extending groove, when the polishing pad is moved along the direction from the rotating axis to the circumference so that the cutting device forms a groove on the polishing surface, the cutting trajectory direction of the groove is the direction from the circumference toward the rotating axis, and vice versa. In another embodiment, when a cutting device is used to form a groove on the polishing surface of the polishing pad, the position of the polishing pad is fixed, and the cutting device moves relative to the polishing pad. At this time, the "cutting trajectory direction" can also be defined as the same direction as the motion direction of the cutting device when the cutting device is used to form a groove on the polishing surface of the polishing pad. For example, in the case of forming a radially extending groove, when the cutting device is moved along the direction from the rotating axis to the circumference so that the cutting device forms a groove on the polishing surface, the cutting trajectory direction of the groove is the direction from the rotating axis toward the circumference, and vice versa.

As shown in FIG. 8, the first cutting trajectory direction 5Da is forward with the first coordinate direction 50*a*, and the second cutting trajectory direction 5Db is reverse with the first coordinate direction 50*a*. That is, in the present embodiment, the first cutting trajectory direction 5Da is opposite to the second cutting trajectory direction 5Db. As mentioned above, the radial coordinate represents the distance from the original point of the two-dimensional orthogonal coordinate system 50 to the pole P, so that the first coordinate direction 50*a* (i.e., the radial direction or the radial coordinate direction) is the direction from the rotating axis C of the polishing pad 500 toward the circumference E of the polishing pad 500. Based on this, in the present embodiment, the first cutting trajectory direction 5Da that is forward with the first coordinate direction 50*a* is the direction from the rotating axis C of the polishing pad 500 toward the circumference E of the polishing pad 500, and the second cutting trajectory direction 5Db that is reverse with the first cutting trajectory direction 5Da is the direction from the circumference E of the polishing pad 500 toward the rotating axis C of the polishing pad 500. In addition, as mentioned above, the rotating axis C is located at the center of the polishing pad 500, so the first cutting trajectory direction 5Da is the direction outward away from the center of the polishing pad 500, and the second cutting trajectory direction 5Db is the direction inward toward the center of the polishing pad 500. However, the present invention is not limited thereto, as long as the first cutting trajectory direction 5Da is opposite to the second cutting trajectory direction 5Db, it falls within the scope of the invention. In other embodiments, the first cutting trajectory direction 5Da may be the direction inward toward the center of the polishing pad 500, and the second cutting trajectory direction 5Db may be the direction outward away from the center of the polishing pad 500.

In the present embodiment, the first grooves 504*a* and the second grooves 504*b* may be arranged alternately along the second coordinate direction 50*b*. As shown in FIG. 8, along the second coordinate direction 50*b* (i.e., the circumferential direction or the angular coordinate direction), the distribution arrangement of the surface pattern 504 is in order of the second groove 504*b*, the first groove 504*a*, the second groove 504*b*, the first groove 504*a*, the second groove 504*b*, the first groove 504*a*, the second groove 504*b*, and the first groove 504*a*. However, the present invention is not limited thereto, as long as the first grooves 504*a* and the second grooves 504*b* are arranged alternately (such as arranged alternately in a periodical manner or in a non-periodical manner), they fall within the scope of the present invention. In other words, the number and the order of the grooves included in the surface pattern 504 can be adjusted according to actual needs. For example, in one embodiment, the distribution arrangement of the surface pattern 504 along the second coordinate direction 50*b* (i.e., the circumferential direction or the angular coordinate direction) may be in order of the first groove 504*a*, the first groove 504*a*, the second groove 504*b*, the first groove 504*a*, the first groove 504*a*, and second groove 504*b*. However, the present invention is not limited thereto. In other embodiments, the arrangement of the first grooves 504*a* and the second grooves 504*b* may be designed according to actual needs.

In addition, as shown in FIG. 8, each first groove 504*a* is disposed adjacent to the second groove 504*b*, and each second groove 504*b* is disposed adjacent to the first groove 504*a*. Specifically, two of the first grooves 504*a* are spaced by the corresponding second groove 504*b*, and two of the second grooves 504*b* are spaced by the corresponding first groove 504*a*. However, the present invention is not limited thereto, as long as there is one first groove 504*a* and one second groove 504*b* adjacent to each other in the surface pattern 504, it falls within the scope of the present invention. For example, as described above, along the second coordinate direction 50*b* (i.e., the circumferential direction or the angular coordinate direction), the distribution arrangement of the surface pattern 504 may be in order of the first groove 504*a*, the first groove 504*a*, the second groove 504*b*, the first groove 504*a*, the first groove 504*a*, and the second groove 504*b*, that is, two first grooves 504*a* may be selected to be adjacent to each other.

Based on the foregoing descriptions of FIG. 1 and FIG. 2, it can be known that in the present embodiment, the polishing pad 500 satisfies the following conditions that: the first groove 504*a* has the first cutting trajectory direction 5Da, the second groove 504*b* has the second cutting trajectory direction 5Db, and the first cutting trajectory direction 5Da is opposite to the second cutting trajectory direction 5Db, so that when the polishing procedure is performed on the object using the polishing pad 500, the polishing pad 500 makes the polishing fluid have different flow field distribution.

In addition, in the present embodiment, the first grooves 504*a* having the first cutting trajectory direction 5Da and the second grooves 504*b* having the second cutting trajectory direction 5Db opposite to the first cutting trajectory direction 5Da are arranged alternately, thereby during the polishing procedure of the object using the polishing pad 500, the polishing pad 500 enables the polishing fluid to have different flow field distribution.

In addition, in other embodiments, the first groove 504*a* and the second groove 504*b* may be modified into radially extending grooves of other shapes. For example, the first groove 504*a* and the second groove 504*b* may be inclined linear grooves having a non-zero degrees included angle or a non-180 degrees included angle with the first coordinate direction 50*a* (i.e., the distribution of the surface pattern is inclined radial linear), or arc grooves having a non-fixed included angle with the first coordinate direction 50*a* (i.e., the distribution of the surface pattern is spiral radial arc). Further, there is a first included angle between the tangent direction of each point on the first cutting trajectory direction 5Da of the first groove 504*a* and the first coordinate direction 50*a*, and the first included angle is less than about 45 degrees and greater than or equal to about 0 degrees. In addition, there is a second included angle between the tangent direction of each point on the second cutting trajectory direction 5Db of the second groove 504*b* and the first coordinate direction 50*a*, and the second included angle is greater than about 135 degrees and less than or equal to about 180 degrees. Other related descriptions and features have been shown in FIG. 8, so that is not repeated again. In particular, in the embodiment of FIG. 8, the foregoing first included angle is equal to an angle of 0 degrees, and the foregoing second included angle is equal to an angle of 180 degrees.

Figure 9:
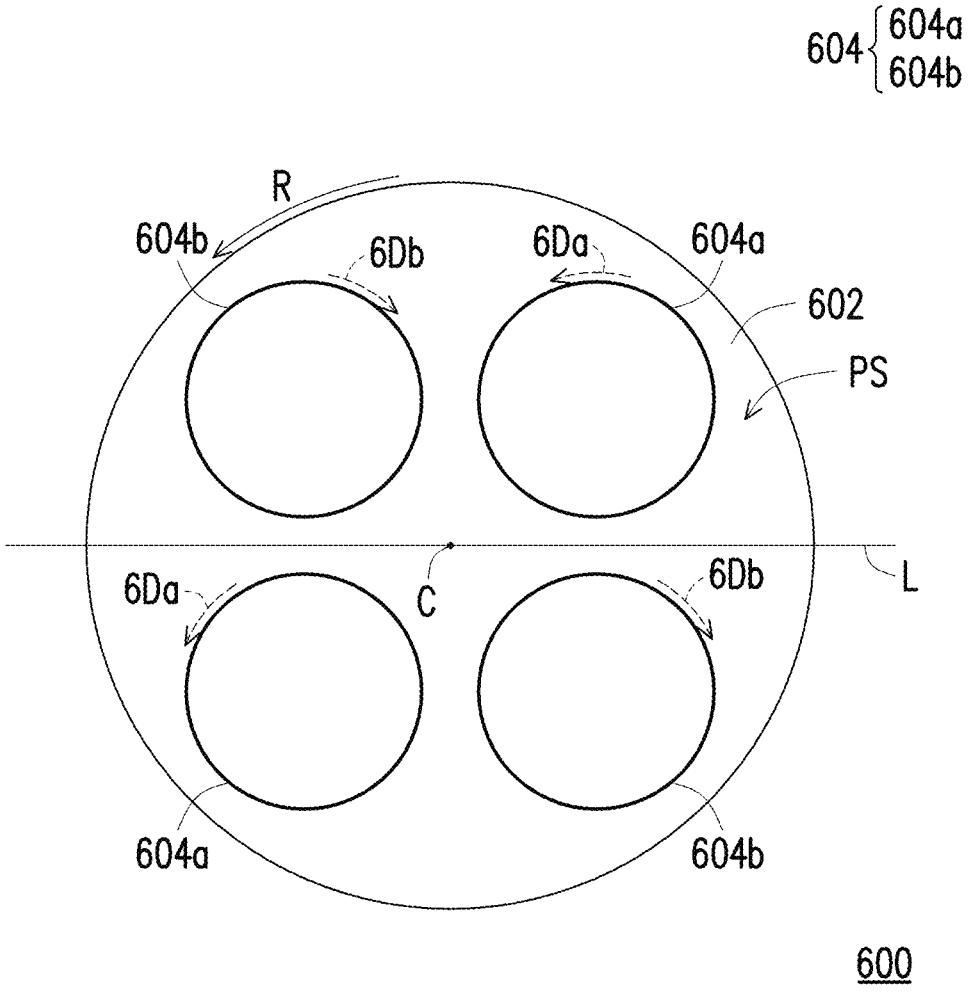
FIG. 9 is a schematic top view of a polishing pad according to another embodiment of the present invention.

FIG. 9 is a schematic top view of a polishing pad according to another embodiment of the present invention. Please refer to both FIG. 9 and FIG. 1, the polishing pad 600 of FIG. 9 is similar to the polishing pad 100 of FIG. 1, so the same or similar components are represented by the same or similar numerals, and the related descriptions are not repeated. It is worth mentioning that the polishing layer 602 and the surface pattern 604 are the same as or similar to the corresponding ones in the embodiment of FIG. 1 (that is, the polishing layer 102 and the surface pattern 104), so the related descriptions are not repeated here. The differences between the polishing pad 600 and the polishing pad 100 will be described below.

In the present embodiment, the rotating axis C of the polishing pad 600 is located at the center of the polishing pad 600. Taking the polishing pad 600 shown in FIG. 9 as a circle, the center of the polishing pad 600 is the center of the circle, that is, the rotating axis C is located at the center of the circle of the polishing pad 600. When the polishing procedure is performed on the object using the polishing pad 600, the polishing pad 600 is fixed on a polishing platen (not shown) of the polishing equipment, and the polishing pad 600 is driven by the polishing platen to rotate along the rotating axis C in the motion direction R. As shown in FIG. 9, with respect to the rotating axis C of the polishing pad 600 (i.e., the center of the polishing pad 600), the motion direction R is a counterclockwise direction, that is, the polishing pad 600 rotates in a counterclockwise direction, but the present invention is not limited thereto. In other embodiments, the motion direction R may also be a clockwise direction.

In the present embodiment, the surface pattern 604 may include at least one first groove 604*a* and at least one second groove 604*b*. As shown in FIG. 9, the at least one first groove 604*a* is exemplified by two first grooves 604*a*, and the at least one second groove 604*b* is exemplified by two second grooves 604*b*. However, the present invention is not limited thereto. The number of the first grooves 604*a* and the number of the second grooves 604*b* can be respectively designed to be one or more than two according to actual needs.

In the present embodiment, the shapes of the first grooves 604*a* and the second grooves 604*b* are circular. In detail, the first grooves 604*a* and the second grooves 604*b* (i.e., the circular grooves) have the same size, and the adjacent two of the first grooves 604*a* and the second grooves 604*b* (i.e., two adjacent circular grooves) have the same spacing. In addition, the centers of the first grooves 604*a* and the second grooves 604*b* (i.e., circular grooves) do not overlap with the rotating axis C of the polishing pad 600 and are located at the positions corresponding to the same radius of the polishing pad 600. That is, in the present embodiment, the surface pattern 604 includes the first grooves 604*a* and the second grooves 604*b* having the same shape distribution.

In the present embodiment, the first groove 604*a* has a first cutting trajectory direction 6Da, and the second groove

604*b* has a second cutting trajectory direction 6Db. In one embodiment, when a cutting device is used to form a groove on the polishing surface of the polishing pad, the position of the cutting device is fixed, and the polishing pad is moved relative to the cutting device. At this time, the "cutting trajectory direction" can be defined as the direction opposite to the motion direction of the polishing pad when a cutting device is used to form a groove on the polishing surface of the polishing pad. For example, in the case that the shape of the groove to be formed is circular, when the polishing pad is moved counterclockwise to make the cutting device form a groove on the polishing surface, the cutting trajectory direction of the groove is a clockwise direction, and vice versa. In another embodiment, when a cutting device is used to form a groove on the polishing surface of the polishing pad, the position of the polishing pad is fixed, and the cutting device moves relative to the polishing pad. At this time, the "cutting trajectory direction" can also be defined as the same direction as the motion direction of the cutting device when the cutting device is used to form a groove on the polishing surface of the polishing pad. For example, in the case that the shape of the groove to be formed is circular, when the cutting device moves clockwise to make the cutting device form a groove on the polishing surface, the cutting trajectory direction of the groove is a clockwise direction, and vice versa.

As shown in FIG. 9, the first cutting trajectory direction 6Da is forward with the motion direction R, and the second cutting trajectory direction 6Db is reverse with the motion direction R. In detail, the motion direction R is a counterclockwise direction, so the first cutting trajectory direction 6Da is a counterclockwise direction, and the second cutting trajectory direction 6Db is a clockwise direction. However, the present invention is not limited thereto, as long as the first cutting trajectory direction 6Da is opposite to the second cutting trajectory direction 6Db, it falls within the scope of the present invention. In other embodiments, when the motion direction R is a clockwise direction, the first cutting trajectory direction 6Da is a clockwise direction, and the second cutting trajectory direction 6Db is a counterclockwise direction.

In the present embodiment, the first grooves 604*a* and the second grooves 604*b* may be arranged alternately along the motion direction R. As shown in FIG. 9, along the motion direction R, the distribution arrangement of the surface pattern 604 is in order of the first groove 604*a*, the second groove 604*b*, the first groove 604*a*, and the second groove 604*b*. However, the present invention is not limited thereto, as long as the first grooves 604*a* and the second grooves 604*b* are arranged alternately (such as arranged alternately in a periodical manner or in a non-periodical manner), they fall within the scope of the present invention. In other words, the number and the order of the grooves included in the surface pattern 604 can be adjusted according to actual needs. For example, in one embodiment, the distribution arrangement of the surface pattern 604 along the motion direction R may be in order of the first groove 604*a*, the first groove 604*a*, the second groove 604*b*, the first groove 604*a*, the first groove 604*a* and the second groove 604*b*. However, the present invention is not limited thereto. In other embodiments, the arrangement manner of the first grooves 604*a* and the second grooves 604*b* may be designed according to actual needs.

In addition, as shown in FIG. 9, each first groove 604*a* is disposed adjacent to the second groove 604*b*, and each second groove 604*b* is disposed adjacent to the first groove 604*a*. Specifically, two of the first grooves 604*a* are spaced by the corresponding second groove 604*b*, and two of the second grooves 604*b* are spaced by the corresponding first groove 604*a*. However, the present invention is not limited thereto, as long as there is one first groove 604*a* and one second groove 604*b* adjacent to each other in the surface pattern 604, it falls within the scope of the present invention. For example, as described above, along the motion direction R, the distribution arrangement of the surface pattern 604 may be in order of the first groove 604*a*, the first groove 604*a*, the second groove 604*b*, the first groove 604*a*, the first groove 604*a* and the second groove 604*b*, that is, two first grooves 604*a* may be selected to be adjacent to each other.

Figure 10:
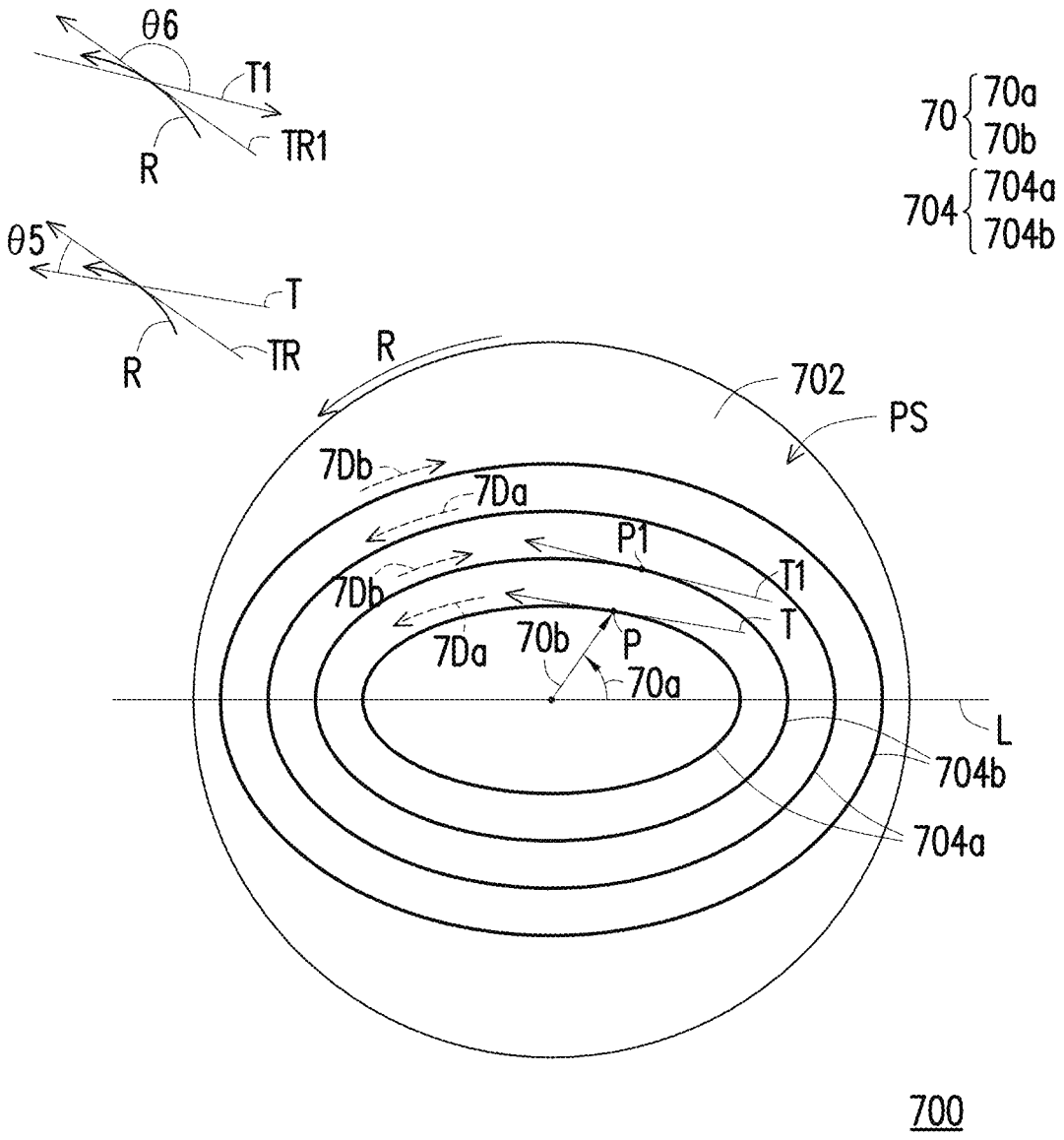
FIG. 10 is a schematic top view of a polishing pad according to another embodiment of the present invention.

In particular, unlike the aforementioned embodiments of FIG. 1, FIG. 5, FIG. 6, FIG. 7, FIG. 8, and subsequent embodiment of FIG. 10, the groove configuration of the polishing pad 600 in the embodiment shown in FIG. 9 does not need to be distributed along a certain coordinate direction in the two-dimensional orthogonal coordinate system, and in addition to the motion direction R, the grooves of the polishing pad 600 in the embodiment shown in FIG. 9 can be also arranged along the row direction or the column direction of the matrix, but the present invention is not limited thereto.

Based on the foregoing descriptions of FIG. 1 and FIG. 2, it can be known that in the present embodiment, the polishing pad 600 satisfies the following conditions that: the first groove 604*a* has the first cutting trajectory direction of 6 Da, and the second groove 604*b* has the second cutting trajectory direction 6Db, and the first cutting trajectory direction 6Da is opposite to the second cutting trajectory direction 6Db, so that when the polishing procedure is performed on the object using the polishing pad 600, the polishing pad 600 makes the polishing fluid have different flow field distribution.

In addition, in the present embodiment, the first grooves 604*a* having the first cutting trajectory direction 6Da and the second grooves 604*b* having the second cutting trajectory direction 6Db opposite to the first cutting trajectory direction 6Da are arranged alternately, thereby during the polishing procedure of the object using the polishing pad 600, the polishing pad 600 enables the polishing fluid to have different flow field distribution.

FIG. 10 is a schematic top view of a polishing pad according to another embodiment of the present invention. Please refer to both FIG. 10 and FIG. 1, the polishing pad 700 in FIG. 10 is similar to the polishing pad 100 in FIG. 1, so the same or similar components are represented by the same or similar numerals, and the related descriptions are not repeated. It is worth mentioning that the polishing layer 702 and the surface pattern 704 are the same as or similar to ones in the embodiment of FIG. 1 (that is, the polishing layer 102 and the surface pattern 104), so the related descriptions are not repeated here. The differences between the polishing pad 700 and the polishing pad 100 will be described below.

In the present embodiment, the polishing surface PS of the polishing layer 702 corresponds to a two-dimensional orthogonal coordinate system 70 having a first coordinate direction 70*a* and a second coordinate direction 70*b*. As shown in FIG. 10, the two-dimensional orthogonal coordinate system 70 is a polar coordinate system, the first coordinate direction 70*a* is an angular coordinate direction, and the second coordinate direction 70*b* is a radial coordinate direction. Those skilled in the art should understand that the radial coordinate represents the distance from the original point of the two-dimensional orthogonal coordinate system 70 to the pole P, and the angular coordinate represents the angular arc of the connection line between the pole P and the original point of the two-dimensional orthogonal coordinate system 70 with respect to the polar axis L in a counterclockwise direction, and the polar axis L is the X-axis in the rectangular coordinate system. In view of this, those skilled in the art should understand that the first coordinate direction 70*a* is also the circumferential direction, and the second coordinate direction 70*b* is also the radial direction. In addition, since the angular coordinate represents the angular arc of the connection line between the pole P and the original point of the two-dimensional orthogonal coordinate system 70 in a counterclockwise direction with respect to the polar axis L, the first coordinate direction 70*a* (i.e., the angular coordinate direction) is a counterclockwise direction.

In the present embodiment, the rotating axis C of the polishing pad 700 corresponds to the original point of the two-dimensional orthogonal coordinate system 70. In addition, as shown in FIG. 10, the rotating axis C is located at the center of the polishing pad 700. Taking the polishing pad 700 shown in FIG. 10 as a circle, the center of the polishing pad 700 is the center of the circle, that is, the rotating axis C is located at the center of the circle of the polishing pad 700. When the polishing procedure is performed on the object using the polishing pad 700, the polishing pad 700 is fixed on the polishing platen (not shown) of the polishing equipment, and the polishing pad 700 is driven by the polishing platen to rotate along the rotating axis C in the motion direction R. As shown in FIG. 10, with respect to the rotating axis C of the polishing pad 700 (i.e., the center of the polishing pad 700), the motion direction R is a counterclockwise direction, that is, the polishing pad 700 rotates in a counterclockwise direction, but the present invention is not limited thereto. In other embodiments, the motion direction R may also be a clockwise direction.

In the present embodiment, the surface pattern 704 may include at least one first groove 704*a* and at least one second groove 704*b*. As shown in FIG. 10, the at least one first groove 704*a* is exemplified by two first grooves 704*a*, and the at least one second groove 704*b* is exemplified by two second grooves 704*b*. However, the present invention is not limited thereto. The number of the first grooves 704*a* and the number of the second grooves 704*b* can be respectively designed to be one or more than two according to actual needs.

In the present embodiment, the shapes of the first groove 704*a* and the second groove 704*b* are elliptical ring. That is, in the present embodiment, the surface pattern 704 includes first grooves 704*a* and second grooves 704*b* having the same shape distribution. In addition, as shown in FIG. 10, the distribution profile of the surface pattern 704 is concentric elliptical ring. That is, in the present embodiment, the center of the first groove 704*a* overlaps the center of the polishing pad 700, and the center of the second groove 704*b* overlaps the center of the polishing pad 700.

In the present embodiment, the first groove 704*a* has a first cutting trajectory direction 7Da, and the second groove 704*b* has a second cutting trajectory direction 7Db. In one embodiment, when a cutting device is used to form a groove on the polishing surface of the polishing pad, the position of the cutting device is fixed, and the polishing pad is moved relative to the cutting device. At this time, the "cutting trajectory direction" can be defined as the direction opposite to the motion direction of the polishing pad when a cutting device is used to form a groove on the polishing surface of the polishing pad. For example, in the case that the shape of the groove to be formed is an elliptical ring, when the polishing pad is moved counterclockwise to make the cutting device form a groove on the polishing surface, the cutting trajectory direction of the groove is a clockwise direction, and vice versa. In another embodiment, when a cutting device is used to form a groove on the polishing surface of the polishing pad, the position of the polishing pad is fixed, and the cutting device moves relative to the polishing pad. At this time, the "cutting trajectory direction" can also be defined as the same direction as the motion direction of the cutting device when the cutting device is used to form a groove on the polishing surface of the polishing pad. For example, in the case that the shape of the groove to be formed is an elliptical ring, when the cutting device is moved clockwise to make the cutting device form a groove on the polishing surface, the cutting trajectory direction of the groove is a clockwise direction, and vice versa.

As shown in FIG. 10, the first cutting trajectory direction 7Da is forward with the first coordinate direction 70*a*, and the second cutting trajectory direction 7Db is reverse with the first coordinate direction 70*a*. That is, in the present embodiment, the first cutting trajectory direction 7Da is opposite to the second cutting trajectory direction 7Db. As mentioned above, in the present embodiment, the first coordinate direction 70*a* and the motion direction R are both counterclockwise, so the first cutting trajectory direction 7Da is also forward with the motion direction R, and the second cutting trajectory direction 7Db is also reverse with the motion direction R. However, the present invention is not limited thereto, as long as the first cutting trajectory direction 7Da and the second cutting trajectory direction 7Db are opposite to each other, it falls within the scope of the present invention. In other embodiments, the first cutting trajectory direction 7Da may be reverse with the motion direction R, and the second cutting trajectory direction 7Db may be forward with the motion direction R.

In addition, as shown in FIG. 10, an included angle θ5 is between the tangential direction T of the first cutting trajectory direction 7Da at the pole P of the first groove 704*a* and the tangential direction TR of the motion direction R at the pole P of the first groove 704*a*, and an included angle θ6 is between the tangential direction T1 of the second cutting trajectory direction 7Db at the pole P1 of the second groove 704*b* and the tangential direction TR1 of the motion direction R at the pole P1 of the second groove 704*b*. In the present embodiment, the included angle θ5 is less than about 45 degrees and greater than or equal to about 0 degrees, and the included angle θ6 is greater than about 135 degrees and less than or equal to 180 degrees. In other words, in the present embodiment, the distribution of the first grooves 704*a* and the second grooves 704*b* does not overlap with the first coordinate direction 70*a*. It is worth mentioning that although FIG. 10 only reveals the relationship between the tangential direction T of the first cutting trajectory direction 7Da and the tangential direction TR of the motion direction R at one pole P of the first groove 704*a*, and the relationship between the tangential direction T1 of the second cutting trajectory direction 7Db and the tangential direction TR1 of the motion direction R at one pole P1 of the second groove 704*b*, those skilled in the art should understand that the included angle θ5 is between the tangential direction of the first cutting trajectory direction 7Da at each point of the first groove 704*a* and the tangential direction of the motion direction R at each point of the first groove 704*a*, and the included angle θ6 is between the tangential direction of the second cutting trajectory direction 7Db at each point of the second groove 704*b* and the tangential direction of the motion direction R at each point of the second groove 704*b*.

In the present embodiment, the first grooves 704*a* and the second grooves 704*b* may be arranged alternately along the second coordinate direction 70*b*. As shown in FIG. 10, along the second coordinate direction 70*b* (i.e., the radial direction or the radial coordinate direction), the distribution arrangement of the surface pattern 704 is in order of the first groove 704*a*, the second groove 704*b*, the first groove 704*a*, and the second groove 704*b*. However, the present invention is not limited thereto, as long as the first grooves 704*a* and the second grooves 704*b* are arranged alternately (such as arranged alternately in a periodical manner or in a non-periodical manner), they fall within the scope of the present invention. In other words, the number and the order of the grooves included in the surface pattern 704 can be adjusted according to actual needs. For example, in one embodiment, the distribution arrangement of the surface pattern 704 along the second coordinate direction 70*b* (i.e., the radial direction or the radial coordinate direction) may be in order of the first groove 704*a*, the first groove 704*a*, the second groove 704*b*, the first groove 704*a*, the first groove 704*a*, and the second groove 704*b*. However, the present invention is not limited thereto. In other embodiments, the arrangement manner of the first grooves 704*a* and the second grooves 704*b* may be designed according to actual needs.

In addition, as shown in FIG. 10, each first groove 704*a* is disposed adjacent to the second groove 704*b*, and each second groove 704*b* is disposed adjacent to the first groove 704*a*. Specifically, two of the first grooves 704*a* are spaced by the corresponding second groove 704*b*, and two of the second grooves 704*b* are spaced by the corresponding first groove 704*a*. However, the present invention is not limited thereto, as long as there is one first groove 704*a* and one second groove 704*b* adjacent to each other in the surface pattern 704, it falls within the scope of the present invention. For example, as described above, along the second coordinate direction 70*b* (i.e., the radial direction or the radial coordinate direction), the distribution arrangement of the surface pattern 704 may be in order of the first groove 704*a*, the first groove 704*a*, the second groove 704*b*, the first groove 704*a*, the first groove 704*a*, and the second groove 704*b*, that is, two first grooves 704*a* may be selected to be adjacent to each other.

Based on the foregoing descriptions of FIG. 1 and FIG. 2, it can be known that in the present embodiment, the polishing pad 700 satisfies the following conditions that: the first groove 704*a* has the first cutting trajectory direction 7Da, the second groove 704*b* has the second cutting trajectory direction 7Db, and the first cutting trajectory direction 7Da is opposite to the second cutting trajectory direction 7Db, so that when the object is subjected to a polishing procedure using the polishing pad 700, the polishing pad 700 makes the polishing fluid have different flow field distribution.

In addition, in the present embodiment, the first grooves 704*a* having the first cutting trajectory direction 7Da and the second grooves 704*b* having the second cutting trajectory direction 7Db opposite to the first cutting trajectory direction 7Da are arranged alternately, thereby during the polishing procedure of the object using the polishing pad 700, the polishing pad 700 enables the polishing fluid to have different flow field distribution.

In addition, according to the above-mentioned descriptions about FIG. 1, FIG. 3, and FIG. 4, those skilled in the art should understand that the manufacturing method of each of the polishing pad 200 shown in FIG. 5, the polishing pad 300 shown in FIG. 6, the polishing pad 400 shown in FIG. 7, the polishing pad 500 shown in FIG. 8, the polishing pad 600 shown in FIG. 9, and the polishing pad 700 shown in FIG. 10, which will not be repeated here. Further, the groove surface pattern of the polishing pad can also be combined with the surface patterns of the foregoing embodiments. In addition, the adjacent grooves in the polishing pads of the previous figures are all shown with the same spacing, but the present invention is not limited thereto. In other embodiments, the adjacent grooves may with different spacings.

Figure 11:
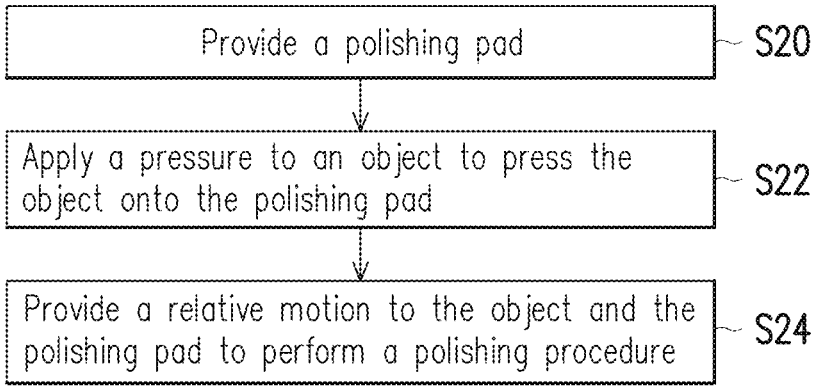
FIG. 11 is a flowchart of a polishing method according to an embodiment of the present invention.

FIG. 11 is a flowchart of a polishing method according to an embodiment of the present invention. This polishing method is suitable for polishing objects. In detail, this polishing method may be applied to a polishing process for manufacturing an industrial component, such as a component used in the electronics industries including semiconductor devices, integrated circuits, micro-electromechanical devices, energy conversion devices, communication devices, optical devices, disks for storage, and displays etc., and objects used for manufacturing the components may include semiconductor wafers, Group III-V wafers, carriers of storage devices, ceramic substrates, polymer substrates, and glass substrates, etc. However, the invention is not limited hereto.

Please refer to FIG. 11. First, in step S20, a polishing pad is provided. In detail, in the present embodiment, the polishing pad may be any of the polishing pads as described in the foregoing embodiments, e.g., the polishing pad 100, 200, 300, 400, 500, 600, or 700. The related descriptions of the polishing pads 100, 200, 300, 400, 500, 600, 700 have been described in detail in the foregoing. Thus, details in this regard are not repeated here.

Next, in step S22, a pressure is applied to an object. In this way, the object is pressed onto the polishing pad and in contact with the polishing pad. In detail, as mentioned above, the object is in contact with the polishing surface PS of the polishing layer 102, 202, 302, 402, 502, 602, or 702. In addition, the method of applying pressure to the object is performed by, for example, using a carrier capable of holding the object.

After that, in step S24, relative motion is provided to the object and the polishing pad, so as to use the polishing pad to perform a polishing procedure on the object to achieve the purpose of planarization. In detail, the method for providing relative motion to the object and the polishing pad is performed by, for example, rotating the polishing platen to drive the polishing pad fixed on the polishing platen to rotate in the rotation direction R.

Although the invention is disclosed as the embodiments above, the embodiments are not meant to limit the invention. Those skilled in the art may make slight modifications and variations without departing from the spirit and scope of the invention. Therefore, the protection scope of the invention shall be defined by the claims attached below.

What is claimed is:

1. A polishing pad, wherein a polishing surface of the polishing pad corresponds to a two-dimensional orthogonal coordinate system having a first coordinate direction and a second coordinate direction, a rotating axis of the polishing pad corresponds to an original point of the two-dimensional orthogonal coordinate system, and the polishing pad comprises:

a polishing layer; and a surface pattern disposed in the polishing layer, the surface pattern including a plurality of first grooves and a plurality of second grooves respectively distributing along the first coordinate direction, wherein each of the plurality of first grooves has a first cutting trajectory direction, the first cutting trajectory direction is forward with the first coordinate direction, and each of the plurality of second grooves has a second cutting trajectory direction, and the second cutting trajectory direction is reverse with the first coordinate direction, and wherein a sidewall of each of the plurality of first grooves has a plurality of first fine burrs that are tipped forward with the first cutting trajectory direction, and a sidewall of each of the plurality of second grooves has a plurality of second fine burrs that are tipped forward with the second cutting trajectory direction.

2. The polishing pad of claim 1, wherein a first included angle is between the first cutting trajectory direction of the plurality of first grooves and the first coordinate direction, and the first included angle is less than 45 degrees and greater than or equal to 0 degrees, and a second included angle is between the second cutting trajectory direction of the plurality of second grooves and the first coordinate direction, and the second included angle is greater than 135 degrees and less than or equal to 180 degrees.

3. The polishing pad of claim 1, wherein the two-dimensional orthogonal coordinate system is a rectangular coordinate system, the first coordinate direction is a +Y-axis direction, and the plurality of first grooves and the plurality of second grooves are respectively distributed along a vertical direction.

4. The polishing pad of claim 1, wherein the two-dimensional orthogonal coordinate system is a rectangular coordinate system, the first coordinate direction is a +X-axis direction, and the plurality of first grooves and the plurality of second grooves are respectively distributed along a horizontal direction.

5. The polishing pad of claim 1, wherein the two-dimensional orthogonal coordinate system is a polar coordinate system, the first coordinate direction is an angular coordinate direction, the a plurality of first grooves and the a plurality of second grooves are respectively distributed along a circumferential direction.

6. The polishing pad of claim 1, wherein the two-dimensional orthogonal coordinate system is a polar coordinate system, the first coordinate direction is a radial coordinate direction, the plurality of first grooves and the plurality of second grooves are respectively distributed along a radial direction.

7. The polishing pad of claim 1, wherein the plurality of first grooves and the plurality of second grooves are arranged alternately along the second coordinate direction.

8. A polishing pad comprising:

a polishing layer; and a surface pattern disposed in the polishing layer, the surface pattern including a plurality of first grooves and a plurality of second grooves having the same shape distribution, wherein each of the plurality of first grooves has a first cutting trajectory direction, each of the plurality of second grooves has a second cutting trajectory direction, and the first cutting trajectory direction is opposite to the second cutting trajectory direction, and wherein a sidewall of each of the plurality of first grooves has a plurality of first fine burrs that are tipped forward with the first cutting trajectory direction, and a sidewall of each of the plurality of second grooves has a plurality of second fine burrs that are tipped forward with the second cutting trajectory direction.

9. The polishing pad of claim 8, wherein the first cutting trajectory direction is a +Y-axis direction, and the second cutting trajectory direction is a —Y-axis direction.

10. The polishing pad of claim 8, wherein the first cutting trajectory direction is a +X-axis direction, and the second cutting trajectory direction is a —X-axis direction.

11. The polishing pad of claim 8, wherein the first cutting trajectory direction is a counterclockwise direction, and the second cutting trajectory direction is a clockwise direction.

12. The polishing pad of claim 8, wherein the first cutting trajectory direction is a direction from the rotating axis of the polishing pad to a circumference of the polishing pad, and the second cutting trajectory direction is a direction from the circumference of the polishing pad to the rotating axis of the polishing pad.

13. The polishing pad of claim 8, wherein the plurality of first grooves and the plurality of second grooves are arranged alternately.

14. A polishing pad for polishing an object, the polishing pad having a motion direction during polishing, the polishing pad comprising:

a polishing layer;

a plurality of first grooves disposed in the polishing layer, wherein each of the plurality of first grooves has a first cutting trajectory direction, and the first cutting trajectory direction is forward with the motion direction; and a plurality of second grooves disposed in the polishing layer, wherein each of the plurality of second grooves has a second cutting trajectory direction, and the second cutting trajectory direction is reverse with the motion direction, and wherein a sidewall of each of the plurality of first grooves has a plurality of first fine burrs that are tipped forward with the first cutting trajectory direction, and a sidewall of each of the plurality of second grooves has a plurality of second fine burrs that are tipped forward with the second cutting trajectory direction.

15. The polishing pad of claim 14, wherein a first included angle is between a tangential direction of the first cutting trajectory direction at each point of each of the plurality of first grooves and a tangential direction of the motion direction at each point of each of the plurality of first grooves, the first included angle is less than 45 degrees and greater than or equal to 0 degrees, and a second included angle is between a tangential direction of the second cutting trajectory direction at each point of each of the plurality of second grooves and a tangential direction of the motion direction at each point of each of the plurality of second grooves, the second included angle is greater than 135 degrees and less than or equal to 180 degrees.

16. The polishing pad of claim 14, wherein the plurality of first grooves and the plurality of second grooves are arranged alternately.

17. A method for manufacturing a polishing pad, comprising:

providing a polishing layer having a polishing surface; and using a cutting device to form a plurality of first grooves on the polishing surface along a first cutting trajectory direction, and form a plurality of second grooves on the polishing surface along a second cutting trajectory direction, wherein each of the plurality of first grooves is adjacent to the each of the plurality of second grooves, and the first cutting trajectory direction is opposite to the second cutting trajectory direction, and wherein a sidewall of each of the plurality of first grooves has a plurality of first fine burrs that are tipped forward with the first cutting trajectory direction, and a sidewall of each of the plurality of second grooves has a plurality of second fine burrs that are tipped forward with the second cutting trajectory direction.

18. The method of claim 17, wherein the cutting device includes a single cutter.

19. The method of claim 17, wherein the cutting device includes a plurality of cutters, wherein a distance between two adjacent cutters is substantially two times of a distance between the first groove and the second groove adjacent to each other.

20. The method of claim 17, wherein the plurality of first grooves and the plurality of second grooves are circular grooves, and a center of the circle of each of the plurality of first grooves overlaps a center of the polishing pad, and a center of the circle of each of the plurality of second grooves overlaps the center of the polishing pad.

21. The method of claim 20, wherein the first cutting trajectory direction is a clockwise direction and the second cutting trajectory direction is a counterclockwise direction with respect to the center of the polishing pad.

22. The method of claim 17, wherein the plurality of first grooves and the plurality of second grooves are linear grooves, and the plurality of first grooves and the plurality of second grooves are parallel to a Y-axis direction.

23. The method of claim 22, wherein the first cutting trajectory direction is a +Y-axis direction, and the second cutting trajectory direction is a —Y-axis direction.

24. The method of claim 17, wherein the plurality of first grooves and the plurality of second grooves are linear grooves, and the plurality of first grooves and the plurality of second grooves are parallel to a X-axis direction.

25. The method of claim 24, wherein the first cutting trajectory direction is a +X-axis direction, and the second cutting trajectory direction is a —X-axis direction.

26. The method of claim 17, wherein the plurality of first grooves and the plurality of second grooves are radially extending grooves, and with respect to a center of the polishing pad, the plurality of first grooves and the plurality of second grooves are distributed radially outward.

27. The method of claim 26, wherein the first cutting trajectory direction is a direction outward away from the center of the polishing pad, and the second cutting trajectory direction is a direction inward toward the center of the polishing pad.

28. A polishing method, comprising:

providing a polishing pad, wherein the polishing pad is the polishing pad of claim 1;

applying a pressure to an object to press the object on the polishing pad; and providing a relative motion to the object and the polishing pad to perform a polishing procedure.

29. A polishing method, comprising:

providing a polishing pad, wherein the polishing pad is the polishing pad of claim 8;

applying a pressure to an object to press the object on the polishing pad; and providing a relative motion to the object and the polishing pad to perform a polishing procedure.

30. A polishing method, comprising:

providing a polishing pad, wherein the polishing pad is the polishing pad of claim 14;

applying a pressure to the object to press the object on the polishing pad; and providing a relative motion to the object and the polishing pad to perform a polishing procedure.

* * * * *